US008020957B2

(12) United States Patent
Kayanaka

(10) Patent No.: US 8,020,957 B2
(45) Date of Patent: Sep. 20, 2011

(54) PRINTING APPARATUS

(75) Inventor: Yoshihisa Kayanaka, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1156 days.

(21) Appl. No.: 11/705,768

(22) Filed: Feb. 14, 2007

(65) Prior Publication Data

US 2007/0188578 A1 Aug. 16, 2007

(30) Foreign Application Priority Data

Feb. 16, 2006 (JP) ..... 2006-039342

(51) Int. Cl.
*B41J 29/38* (2006.01)

(52) U.S. Cl. ..... 347/16; 347/2; 347/19; 347/104

(58) Field of Classification Search ..... 347/10, 347/14, 19, 104, 2–5, 16
See application file for complete search history.

(56) References Cited

U.S. PATENT DOCUMENTS

| | | | | |
|---|---|---|---|---|
| 6,827,414 | B2 | 12/2004 | Iwatsuki et al. | |
| 6,908,190 | B2 | 6/2005 | Iwatsuki et al. | |
| 7,040,748 | B2 | 5/2006 | Niimi et al. | |
| 7,237,890 | B2 | 7/2007 | Niimi et al. | |
| 7,413,301 | B2 | 8/2008 | Niimi et al. | |
| 2003/0002090 | A1 * | 1/2003 | Clifton | 358/475 |
| 2004/0179081 | A1 * | 9/2004 | Nimi et al. | 347/104 |
| 2005/0051071 | A1 * | 3/2005 | Codos et al. | 112/475.08 |
| 2005/0151773 | A1 | 7/2005 | Watarai | |
| 2008/0238978 | A1 * | 10/2008 | Niimi | 347/16 |

FOREIGN PATENT DOCUMENTS

| | | |
|---|---|---|
| JP | A-2001-262459 | 9/2001 |
| JP | A 2003-311938 | 11/2003 |
| JP | A-2003-312069 | 11/2003 |
| JP | A-2004-284305 | 10/2004 |
| JP | A 2005-199507 | 7/2005 |

* cited by examiner

*Primary Examiner* — Matthew Luu
*Assistant Examiner* — Rut Patel
(74) *Attorney, Agent, or Firm* — Oliff & Berridge PLC

(57) ABSTRACT

A printing apparatus, having a recording system with a nozzle surface, a platen installed in a position to face the nozzle surface to hold the recording medium with a clearance provided between the nozzle surface and a surface of the recording medium held by the platen, a feeding system to carry the platen to a recording position, a detecting system which scans the surface of a recording medium to detect an object that may otherwise interfere the nozzle surface on the recording medium by scanning the surface of the recording medium, a scan objective area determining system to determine a scan objective area, which is an area to be scanned by the detecting system, and a scan controlling system which controls the detecting system to scan the scan objective area determined by the scan objective area determining system to detect the object on the recording medium, is provided.

8 Claims, 15 Drawing Sheets

121

| STORAGE AREA FOR PLATEN INFORMATION TABLE | | | | | |
|---|---|---|---|---|---|
| PLATEN TYPE | ID | SIZE (HORIZONTAL) | SIZE (VERTICAL) | OFFSET (HORIZONTAL) | OFFSET (VERTICAL) |
| LARGE | 0 | 14 inch | 16 inch | 0 inch | 0 inch |
| SMALL | 1 | 10 inch | 12 inch | 2 inch | 2 inch |

FIG.12

PRINTING APPARATUS

CROSS REFERENCE TO RELATED APPLICATION

This application claims priority from Japanese Patent Application No. 2006-039342, filed on Feb. 16, 2006, the entire subject matter of which is incorporated herein by reference.

BACKGROUND

1. Technical Field

Aspects of the present invention relate to a printing apparatus, and more specifically to a printing apparatus capable of detecting an obstacle such as a crease and dust on a recording medium.

2. Related Art

When a piece of fabric is used as a recording medium in a conventional inkjet printing apparatus having a platen to hold the recording medium while the platen is driven in a direction perpendicular with respect to a direction wherein the recording medium is moved, a surface of the fabric may often have obstacles such as dust thereon or a crease to obstruct ink from being ejected onto the surface. In order to prevent printing quality of the printing apparatus to be deteriorated by the obstacles, an inkjet printing apparatus having a detecting system to detect the obstacles prior to a printing operation has been provided. An example of such an inkjet printing apparatus is disclosed in Japanese Patent Provisional Publication No. 2005-199507.

In the above-referenced inkjet apparatus, the detecting system scans not only an area on the fabric to be printed but the entire platen even when the area to be printed is merely a part of the platen. Thus, an area whereon printing is not applied is unnecessarily scanned, and thereby longer time is required to complete the scanning operation. If the fabric as a recording medium has raised parts such as a collar and a pocket in an area outside the area to be printed, the raised parts are detected by the detecting system against a user's intention. Therefore, the user is required to pay attention to the area of the fabric to be placed on the platen so that the raised parts should not be placed on the platen when the fabric is set or to stop the scanning operation before the detecting system starts scanning the raised parts.

SUMMARY

Aspects of the present invention are advantageous in that a printing apparatus capable of detecting an obstacle such as a crease and dust on a recording medium so that an operation duration required for detecting the obstacle is shortened and a user is released from a necessity of monitoring an area to be printed on the recording medium is provided.

BRIEF DESCRIPTION OF THE ACCOMPANYING DRAWINGS

FIG. 12 illustrates a configuration of a platen information table storing area according to the first embodiment of the invention.

DETAILED DESCRIPTION

General Overview

Figure 1:
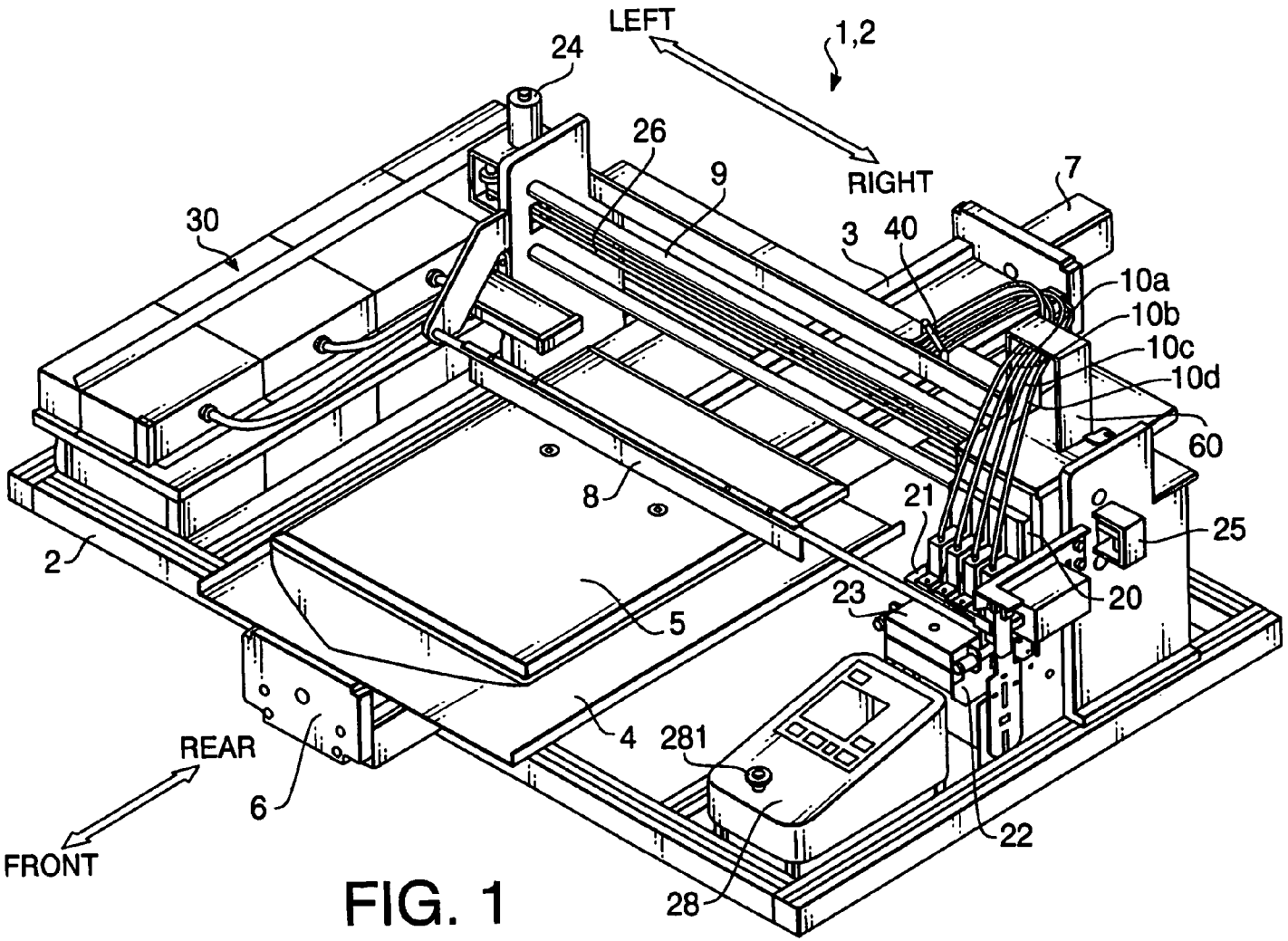
FIG. 1 is a perspective view of an inkjet printer according to a first embodiment of the invention.

The following describes general aspects of the invention that may or may not be included in various examples and modifications. It should be noted that various connections are set forth between elements in the following description. It should be noted that these connections in general and, unless specified otherwise, may be direct or indirect and that this specification is not intended to be limiting in this respect.

According to some aspects of the invention, there is provided a printing apparatus, comprising a recording system with a nozzle surface from which ink is ejected onto a recording medium according to recording data, a platen which is installed in a position to face the nozzle surface to hold the recording medium with a clearance provided between the nozzle surface and a surface of the recording medium held by the platen, a feeding system to carry the platen to a recording position wherein the recording system forms an image on the recording medium according to the recording data, a detecting system which scans the surface of the recording medium to detect an object that may otherwise interfere the nozzle surface on the recording medium by scanning the surface of the recording medium, a scan objective area determining system to determine a scan objective area, which is an area to be scanned by the detecting system, based on a size of the platen and a record objective area being indicated in the recording data and on which the image is formed by the recording system, and a scan controlling system which controls the detecting system to scan an area on the recording medium including the scan objective area determined by the scan objective area determining system to detect the object on the recording medium.

According to the printing apparatus in the above configuration, the record objective area, in which an obstacle on the recording medium should be detected, is exclusively scanned by the detecting system. Therefore, as the platen can be prevented from being unnecessarily fed further than the record objective area, time required for scanning the recording medium can be shortened. Even when the obstacle is present outside the record objective area on the recording medium, the obstacle is not detected by the detecting system, therefore, a sequence of a printing operation is not ceased by the obstacle so that the printing operation can be executed without interruption.

Optionally, the platen may be any one of a plurality of types of exchangeable platens. The recording data may include information regarding at least one of a size and a type of the platen to be used in the printing apparatus. The scan objective area determining system may determine the area to be scanned based on the information regarding at least one of the size and the type of the platen.

According to the printing apparatus in the configuration described above, a plurality of types of platens can be used, and the scan objective area can be determined according to a feature of each of the platens so that scanning of the scan objective area is executed effectively.

Optionally, the platen may be any one of a plurality of types of exchangeable platens. A platen type detecting system to detect a type of the platen being installed in the printing apparatus may be provided. A platen size storing system to store a size of the platen for each type of the exchangeable platen may be provided. The scan objective area determining system may determine the scan objective area by obtaining the size of the platen detected by the platen type detecting system.

According to the printing apparatus in the configuration described above, a plurality of types of platens can be used, and the scan objective area can be determined according to a feature of each of the platens so that scanning of the scan objective area is executed effectively.

Optionally, the scan objective area may range from a record finishing position, in which forming the image is finished, to a record starting position, in which forming the image is started. The scan objective area determining system may comprise a first detection finish feeding amount calculating system, which executes a calculation to obtain a first detection finish feeding amount indicating an amount for the platen to be carried from a ready position, wherein the platen stand by before an operation of the recording system to form the image, to a scanning finish position, wherein the record starting position coincides with the recording position, based on the size of the platen and the record objective area being indicated in the recording data, and a first detection start feeding amount calculating system, which execute a calculation to obtain a first detection start feeding amount indicating an amount for the platen to be carried from the ready position to a first scanning start position, wherein the record finishing position coincides with the recording position, based on the size of the platen and the record objective area being indicated in the recording data. The scan controlling system may activate the detecting system to scan the area on the recording medium including the scan objective area when the platen is carried from the ready position to the first scanning start position by the feeding system and ceases the detecting system scanning the scan objective area when the platen is carried to the first detection scanning finish position.

According to the printing apparatus in the configuration described above, the record objective area is exclusively scanned so that the remaining area that does not affect a printed output is not detected by the detecting system. Thus, time required for scanning the recording medium can be shortened. Therefore, a sequence of an printing operation is not ceased by an obstacle on the remaining area so that the printing operation can be executed without interruption.

Optionally, the printing apparatus may further comprise a reference platen having a size as a reference size, and a reference feeding amount storing system to store a reference detection start feeding amount, which is an amount of the reference platen to be carried from the ready position to a reference record starting position, wherein an upper end of a record objective area of the reference platen coincides with the recording position. The platen may have a vertical length which is parallel to a feeding direction of the platen and the reference platen has a vertical length which is parallel to a feeding direction of the reference platen. The first detection finish feeding amount calculating system may execute the calculation to obtain the first detection finish feeding amount by obtaining a difference between one of the vertical length of the platen which is indicated in the recording data, the vertical length of the platen which is determined based on the type of the platen, and the vertical length of the platen which is obtained from the platen size storing system, and the vertical length of the reference platen, dividing the difference by two, combining a length from an upper end of the platen to the upper end of the record objective area with the divided difference, and subtracting the combined length from the reference detection start feeding amount stored in the reference feeding amount storing system. The recording data may include information indicating a feeding amount of the platen to be carried when the image is formed on the recording medium according to the recording data. The first detection start feeding amount calculating system may execute the calculation to obtain the first detection start feeding amount by determining a vertical length of the record objective area based on the feeding amount of the platen to be carried when the image according to the recording data is formed within a range from the upper end to a lower end of the record objective area, and subtracting the vertical length of the record objective area from the first detection finish feeding amount.

According to the printing apparatus in the configuration described above, the scan objective area can be determined according to a size of the platen to be used.

Optionally, a side of the platen closer to a downstream side with respect to the feeding direction of the platen may be a lower side of the platen when the platen is carried to the recording position by the feeding system so that the image is formed on the recording medium held by the platen. The scan objective area may range from the lower side of the platen to the record starting position, in which forming the image by the recording system is started. The scan objective area determining system may comprise a second detection finish feeding amount calculating system, which executes a calculation to obtain a second detection finish feeding amount indicating an amount for the platen to be carried from a ready position, wherein the platen stand by before an operation of the recording system to form the image, to a scanning finish position, wherein the record starting position coincides with the recording position, based on the size of the platen and the record objective area being indicated in the recording data. The scan controlling system may activate the detecting system to scan the area on the recording medium including the scan objective area when the platen starts to be carried from the ready position to the second scanning start position by the feeding system and ceases the detecting system scanning the scan objective area when the platen is carried to the second detection scanning finish position.

According to the printing apparatus in the configuration described above, an area ranging from the lower side of the platen to the lower side of the record objective area in addition to the record objective area can be determined to be the scan objective area, thus, an area ranging from the upper end of the record objective area to the upper end of the platen is not included in the scan objective area wherein no scanning is executed by the detecting system. Thus, time required for scanning the recording medium can be shortened. Therefore, a sequence of an printing operation is not ceased by an obstacle on the remaining area so that the printing operation can be executed without interruption.

Optionally, the printing apparatus may further comprise a reference platen having a size as a reference size, and a reference feeding amount storing system to store a reference detection start feeding amount, which is an amount of the reference platen to be carried from the ready position to a reference record starting position, wherein an upper end of a record objective area of the reference platen coincides with the recording position. The platen may have a vertical length which is parallel to a feeding direction of the platen and the reference platen has a vertical length which is parallel to a feeding direction of the reference platen. The second detection finish feeding amount calculating system may execute the calculation to obtain the second detection finish feeding amount by obtaining a difference between one of the vertical length of the platen which is indicated in the recording data, the vertical length of the platen which is determined based on the type of the platen, and the vertical length of the platen which is obtained from the platen size storing system, and the vertical length of the reference platen, dividing the difference by two, combining a length from an upper end of the platen to the upper end of the record objective area with the divided difference, and subtracting the combined length from the reference detection start feeding amount stored in the reference feeding amount storing system.

According to the printing apparatus in the configuration described above, the scan objective area can be determined according to a size of the platen to be used.

Optionally, an error may be indicated to a user of the printing apparatus when the detecting system detects the object that may otherwise interfere the nozzle surface of the recording system.

According to the printing apparatus in the configuration described above, the user of the printing apparatus can correct the error condition by removing the obstacle from the recording medium so that the image can be properly formed on the recording medium.

According to some aspects of the invention, there is provided a detecting system for a printing apparatus having a recording system that forms an image on a recording medium according to recording data, which is adapted to scan the surface of the recording medium to detect an object that may otherwise interfere the recording system on the recording medium by scanning the surface of the recording medium. The printing apparatus comprises a platen which is installed in a position to face the recording system to hold the recording medium with a clearance provided between the recording system and a surface of the recording medium held by the platen, a feeding system to carry the platen to a recording position wherein the recording system forms an image on the recording medium according to the recording data, a scan objective area determining system to determine a scan objective area, which is an area to be scanned by the detecting system, based on a size of the platen and a record objective area being indicated in the recording data and on which the image is formed by the recording system, and a scan controlling system which controls the detecting system to scan an area on the recording medium including the scan objective area determined by the scan objective area determining system to detect the object on the recording medium.

DETAILED DESCRIPTION

Hereinafter, referring to accompanying drawings, embodiments of the present invention will be described. First, referring to FIG. 1, an entire configuration of the inkjet printer 1 will be described. FIG. 1 is a perspective view of the inkjet printer 1 according to the first embodiment of the invention. In the present embodiment, the inkjet printer 1 is a commercially used inkjet printer capable of printing an image on clothing fabric such as a T-shirt based on image information.

As shown in FIG. 1, the inkjet printer 1 includes a substantially box-shaped chassis 2 with two rails 3 aligned in parallel with a front-rear direction as indicated by an arrow at an approximate center of a bottom surface thereof. The rails 3 are supported by bases (not shown) which are positioned perpendicularly with respect to the bottom surface of the chassis 2. The rails 3 support a plate as a platen base (not shown) which is movable in the front-rear direction of the chassis along the rails 3. Further, the platen base is provided with a platen mount (not shown) that extends perpendicularly with respect to the platen base at a substantial center of the platen base. An exchangeable platen 5 is set on top of the platen mount.

The platen 5 is a substantially rectangular-shaped plate and detachably attached to the platen mount with longer sides thereof aligned in parallel with the front-rear direction of the chassis 2, and clothing fabric F as a recording medium is placed on the platen 5. A top surface of the platen 5 is provided with a slip stopper (not shown), which prevents the fabric F tensely placed on the platen 5 from being displaced during the printing operation. In a position between the platen 5 and the platen base is provided a tray 4, which is fixed to the platen mount and has a bottom surface being substantially parallel with the top surface of the platen 5. The tray 4 is substantially larger than the platen 5 in a plan view. The tray 4 is provided so that a remaining part of the fabric F other than the area to be printed such as sleeves of the T-shirt is received thereby and prevented from hanging over the bottom surface of the chassis 2 when the T-shirt is set on the platen 5. The inkjet printer 1 is provided with a plurality of shapes of exchangeable platens 5, so that a suitable shape of platen 5 is used depending on a size and a characteristic of the fabric F.

A platen drive mechanism 6 includes the rails 3, along which the platen base is carried in the front-rear direction of the chassis 2 by a platen drive motor 7, as the platen motor 7 is provided at a rear end of the platen drive mechanism 6. As a drive shaft of the platen drive motor 7 and a pulley (not shown) provided in vicinity of front ends of the rails 3 are bound with a drive belt (not shown), the platen base fixed to the drive belt is reciprocated along the rails 3 by drive force generated by the platen drive motor 7. It should be noted that in the present embodiment a position of the platen 5 when the platen 5 is at the front ends of the rails 3 is referred to as a ready position wherein the platen 5 is located when the printing operation is started. Further, a side wherein the front ends of the rails 3 are located is referred to as a downstream side, while a side wherein the rear ends of the rails 3 are located is referred to as an upstream side.

At an approximate center of the chassis 2 in the front-rear direction, above the platen 5, a guide rail 9 to guide a carriage 20 with an inkjet head 21 mounted is provided. In vicinity of a left-hand end of the guide rail 9, a carriage motor 24 to drive the carriage 20 is provided, while a pulley 25 is provided in vicinity of a right-hand end of the guide rail 9. Further, a carriage belt 26 is drawn between the carriage motor 24 and the pulley 25 under the guide rail 9. The carriage belt 26 is fixed to a rear surface of the carriage 20 so that the carriage 20 is reciprocated along the guide rail 9, which is coupled to the carriage 20 at a coupling portion (not shown) being fixed to the rear surface of the carriage 20 when the carriage motor 24 is activated. The carriage motor 24 is a DC motor, of which position on the guide rail 9 is detected by a linear encoder (not shown) provided to the guide rail 9.

At a position toward the front from the guide rail 9, a clearance sensor system 8, which extends in a direction substantially perpendicular to the front-rear direction, is provided. The clearance sensor system 8 scans the surface of the fabric F and detects an obstacle Fa such as dust and a crease formed on the fabric F set on the platen 5 when the platen 5 is carried along the rails 3 from a position at the downstream side to the upstream side of the rails 3 as the printing operation starts. Therefore, the clearance sensor system 8 requires to be in front of the guide rail 9 and is preferable to be arranged in vicinity of the guide rail 9 in order to avoid additional dust to adhere to the fabric F after the fabric F is scanned by the clearance sensor system 8.

The carriage 20 is substantially box-shaped and provided with four piezoelectric inkjet heads 21 at a bottom thereof. A number of the inkjet heads 21 provided to the carriage 20 corresponds to a number of colors of inks used in the inkjet printer 1. In the present embodiment, the four inkjet heads 21 are provided in correspondence with colors of cyan, magenta, yellow, and black. Each inkjet head 21 is provided with a plurality of (for example, 128) channels (not shown) through which the ink is conveyed. Further, each of the channels is provided with an ejection nozzle (not shown) that is open at a nozzle surface 211 (see FIG. 7) of the inkjet head 21. On the nozzle surface 211, the ejection nozzles are aligned in a direction parallel with respect to the rails 3 (hereinafter, a carrying direction of the platen 5 or a sub-scanning direction) at predetermined equal spaces. Each of the channels is provided with a piezoelectric actuator (not shown), which is activated individually to eject an ink drop downward onto the fabric F from the ejection nozzles. The inkjet heads 21 are aligned along a direction parallel to the guide rail 9 (hereinafter, a main scanning direction) to be mounted on the carriage 20. As the carriage 20 is carried in the main scanning direction with the inks being ejected from the ejection nozzles of the four inkjet heads, line printing is applied to the fabric F as the recording medium. When printing for a line is completed, the platen 5 holding the fabric F is fed for an amount corresponding to the line in the sub-scanning direction. As the line printing and feeding of the fabric F is repeated, a desired image is printed on the fabric F.

At a left-hand side of the inkjet printer 1, an ink cartridge storage unit 30 wherein ink cartridges having the inks therein are stored is provided. The ink cartridge storage unit 30 is connected to each of the inkjet heads 21 by ink supplying tubes 10*a*-10*d* so that the inks of the four colors (i.e., cyan, magenta, yellow, and black) stored in the ink cartridges are supplied to each channel of the inkjet heads 21 through the ink supplying tubes 10*a*-10*d*. The ink supplying tubes 10*a*-10*d* are flexible tubes made of a resin such as polyethylene, which can be bent and twisted to a certain extent according to the movement of the carriage 20.

The ink supplying tubes 10*a*-10*d* are connected to the inkjet heads 21 respectively from the ink cartridge storage unit 30 via a guiding member 40 and a tube supporting member 60. The guiding member 40 is arranged in an approximate center in a direction (a right-left direction) perpendicular to the front-rear direction above the platen 5 to hold the ink supplying tubes 10*a*-10*d* behind the carriage 20. The tube supporting member 60 to hold the ink supplying tubes 10*a*-10*d* as well is provided at an upper surface of the carriage 20. Thus the inks in each ink cartridge is supplied to the inkjet heads 21 as each of the ink supplying tubes 10*a*-10*d* is extended through the tube supporting member 60 to one of the inkjet heads 21.

At a position corresponding to the carriage 20 being carried to the right-hand end of the guide rail 9, a purge unit 22 with a suction cap 23, which can be closely attached to and separated from the nozzle surfaces 211, is provided. The purge unit 22 is provided with a suction pump (not shown) so that the inks remaining in the ejection nozzles can be removed therefrom when the suction caps 23 are attached to the nozzle surfaces 211. Further, when the inkjet printer 1 is not in a printing operation, the nozzle surfaces 211 are covered by the suction caps 23 so that the inks in the nozzle surfaces 211 can be prevented from being dried.

At right-hand front of the chassis 2 is provided an operation panel 28 to which a user inputs an instruction for the inkjet printer 1. The operation panel 28 is provided with a print button 281, which is pressed by the user when a printing operation is started. Further, the inkjet printer 1 is provided with a control unit 100 (not shown) with a CPU 110 to control the inkjet printer 1 inside the chassis 2. The control unit 100 will be described in detail later.

Further, in vicinity of the front ends of the rails 3, a photo sensor (not shown) to detect a position of the platen 5 when the platen 5 being moved from the rear side toward the front side of the chassis 2 is at the end of the movement in the printing operation is provided. The photo sensor includes a light emitting unit and a light receiving unit. In the photo sensor, an object is detected based on a judgment as to whether light emitted from the light emitting unit is received by the light receiving unit. On a lower surface of the platen base, an interceptive plate (not shown) that intercepts the light emitting unit and the light receiving unit so that a position of the platen 5 can be detected is provided. The platen drive motor 7 is a stepping motor, and with this configuration, a position of the platen 5 carried by the platen drive motor 7 is detected based on a base position, wherein the platen 5 with the interceptive plate intercepting the light emitting unit and the light receiving unit is located at the end of the movement.

When printing is applied to the recording medium, the user sets the fabric F as the recording medium on the platen 5 located at the ready position and presses the print button 281. Next, the platen 5 is carried toward the upstream side (the rear ends of the rails 3) and stopped at a position wherein a record starting position on the platen 5 is directly under the guide rail 9. A direction to carry the platen 5 is shifted backwards (a direction toward the downstream side of the rails 3), and printing is started as the inks are ejected onto the fabric F from the inkjet heads 21. When printing for a line is completed, the platen 5 holding the fabric F is carried for an amount corresponding to the line in the sub-scanning direction. As the line printing and feeding of the fabric F is repeated, and all the lines are printed, a desired image is formed on the fabric, and the platen 5 is carried to the ready position, wherein the user can remove the fabric F from the platen 5.

Figure 2:
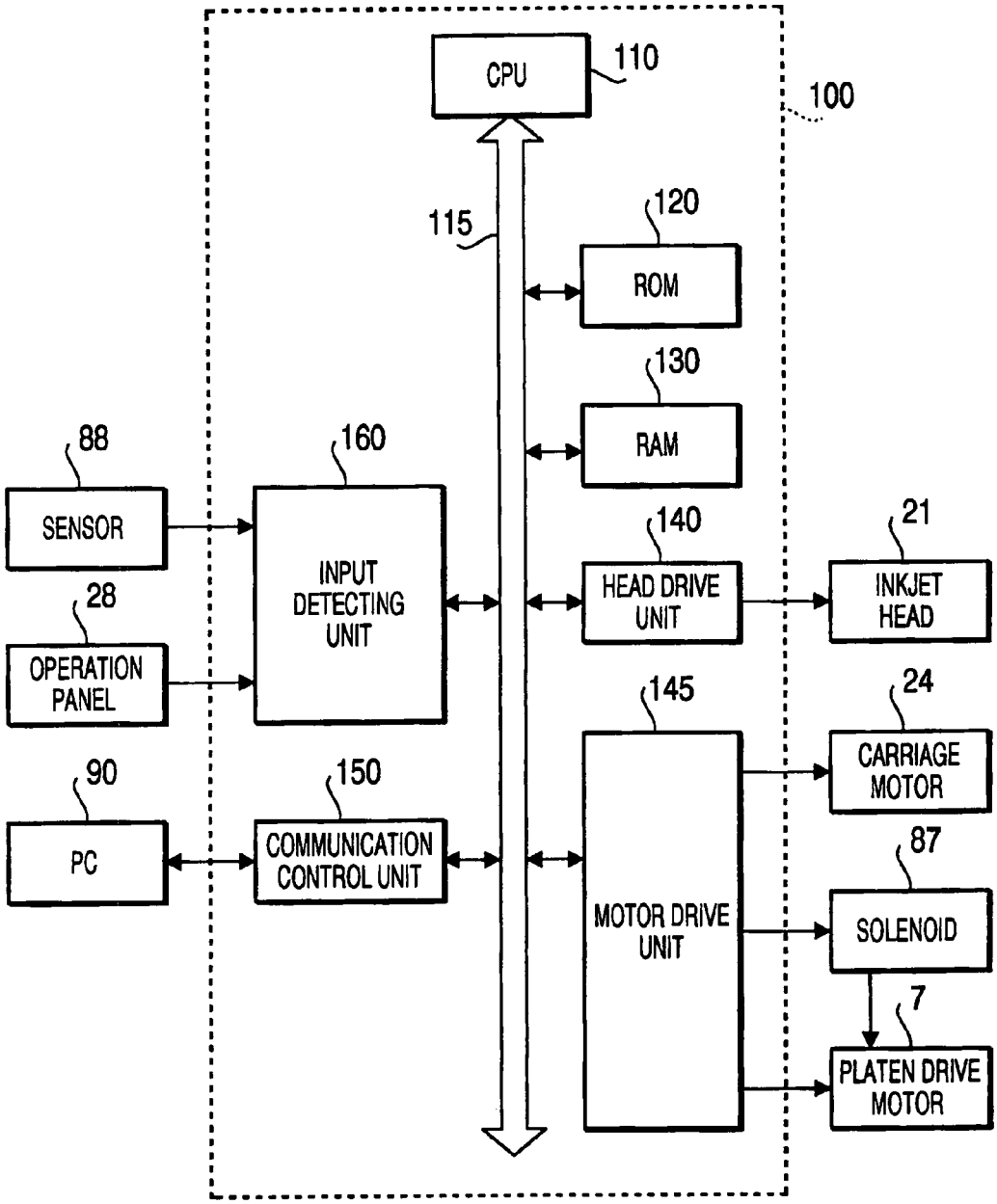
FIG. 2 is a block diagram showing an electrical configuration of the inkjet printer according to the first embodiment of the invention.
Figure 3:
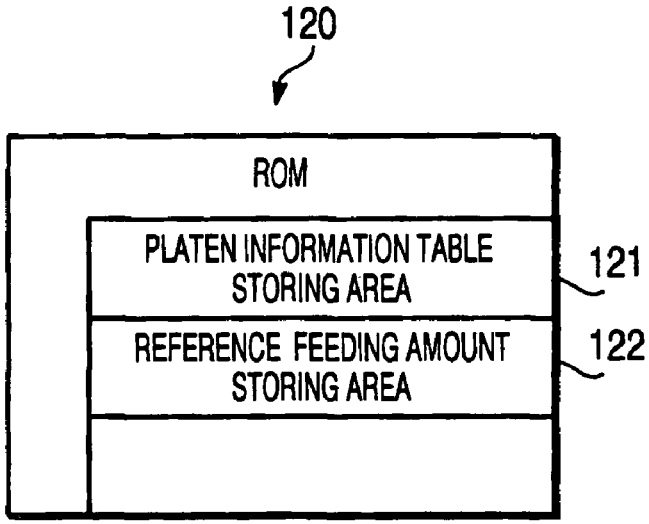
FIG. 3 illustrates a configuration of a ROM in a control unit of the inkjet printer according to the first embodiment of the invention.
Figure 4:
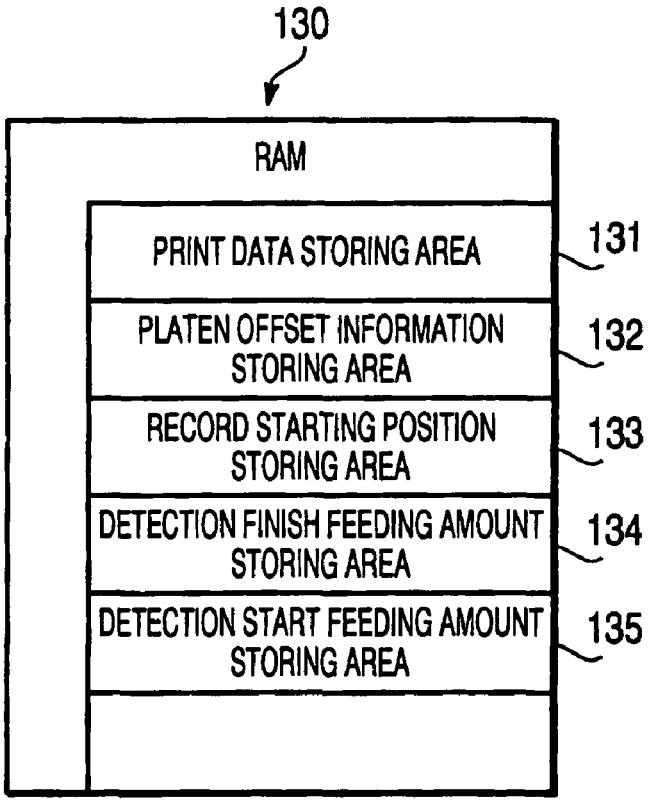
FIG. 4 illustrates a configuration of a RAM in the control unit of the inkjet printer according to the first embodiment of the invention.

Next, referring to FIGS. 2-4, an electrical configuration of the inkjet printer 1 will be described. FIG. 2 is a block diagram showing the electrical configuration of the inkjet printer 1 according to the embodiment of the invention. FIG. 3 illustrates a configuration of a ROM 120 in a control unit 100 of the inkjet printer 1 according to the embodiment of the invention. FIG. 4 illustrates a configuration of a RAM 130 in the control unit 100 of the inkjet printer 1 according to the embodiment of the invention. As shown in FIG. 2, the control unit 100 of the inkjet printer 1 is provided with a CPU 110 that controls the entire operation in the inkjet printer 1. The CPU 110 is connected with the ROM 120, wherein various information to be used in control programs executed by the CPU 110 is stored, and the RAM 130, wherein various information is temporally stored via a bus 115. The CPU 110 is further connected with a head drive unit 140, which activates the piezoelectric actuators being provided to each channel of the inkjet head 21, a motor drive unit 145, which controls driving the carriage motor 24 and the platen drive motor 7, and a communication control unit 150, which controls communication between the inkjet printer 1 and a PC (personal computer), via the bus 115. The motor control unit 145 is connected to a solenoid 87 equipped to the clearance sensor system 8 so that the solenoid 87 is controlled by the motor control unit 145. An input detecting unit 160 is connected with an operation panel 28 and a photo sensor (not shown). The input detecting unit 160 is further connected with a sensor 88, which is provided to the clearance sensor system 8. Light transmitted inside a concave portion 95 of the sensor 88 is intercepted by an interceptive plate 85, and thereby the interceptive plate 85 is detected (see FIGS. 5-8).

Next, referring to FIG. 3, a storage area of the ROM 120 will be described. As shown in FIG. 3, the ROM 120 is provided with a platen information table storing area 121 and a reference feeding amount storing area 122. In the platen information table storing area 121, information concerning the platen 5 such as a size thereof and an amount of offset is stored. In the reference feeding amount storing area 122, a value indicating a reference amount for feeding, which is used when a scanning area of the clearance sensor system 8 is determined, is stored.

Next, referring to FIG. 4, a storage area of the RAM 130 will be described. As shown in FIG. 4, the RAM 130 is provided with a print data storing area 131, a platen offset information storing area 132, a record starting position information storing area 133, a detection finish feeding amount storing area 134, and a detection start feeding amount storing area 135. In the print data storing area 131, data for printing transmitted from the PC 90 is stored. In the platen offset information storing area 132, the record starting position information storing area 133, the detection finish feeding amount storing area 134, and the detection start feeding amount storing area 135, information indicating values used when a scanning area of the clearance sensor system 8 is determined, is stored.

Figure 5:
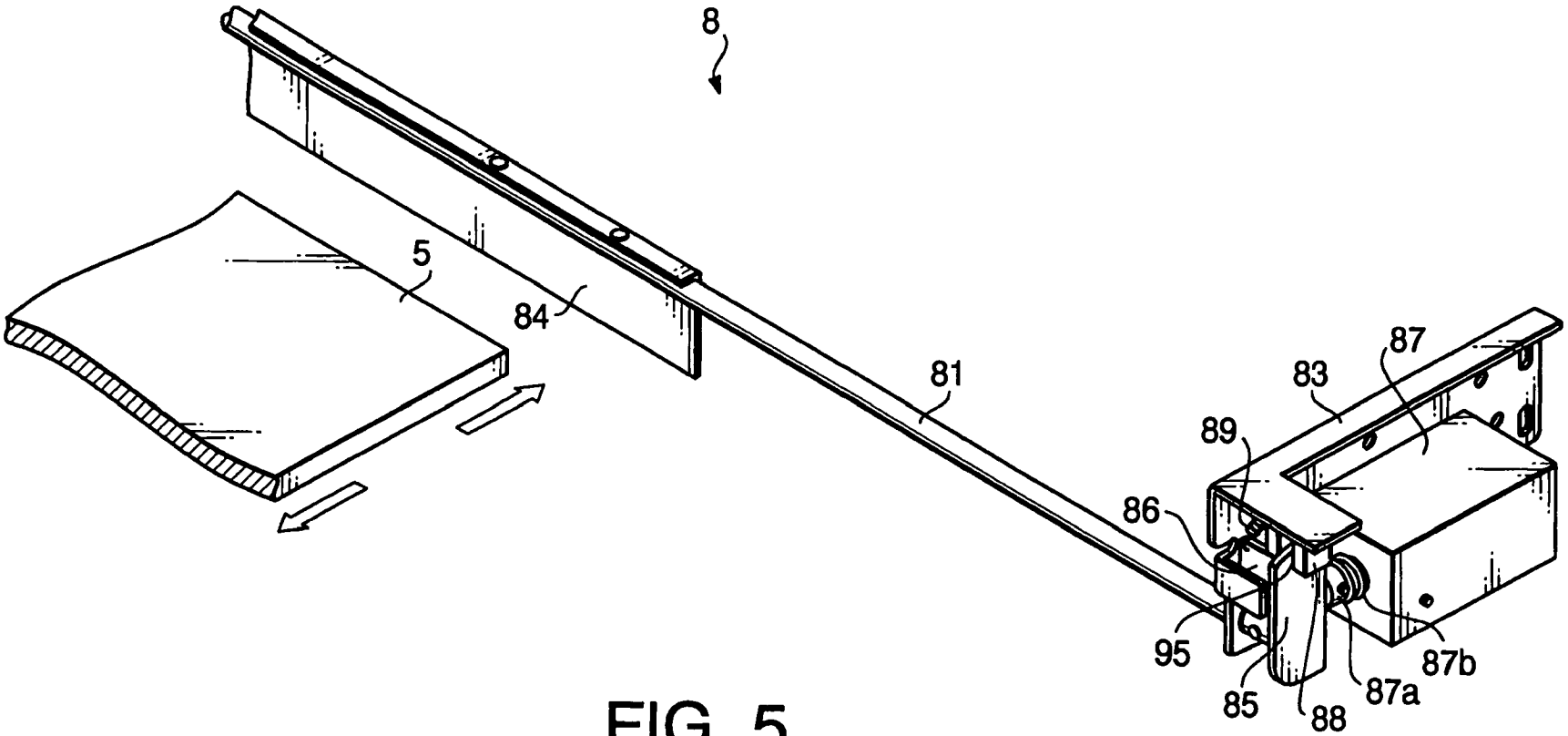
FIG. 5 is a perspective view of a clearance sensor system of the inkjet printer according to the first embodiment of the invention.
Figure 6:
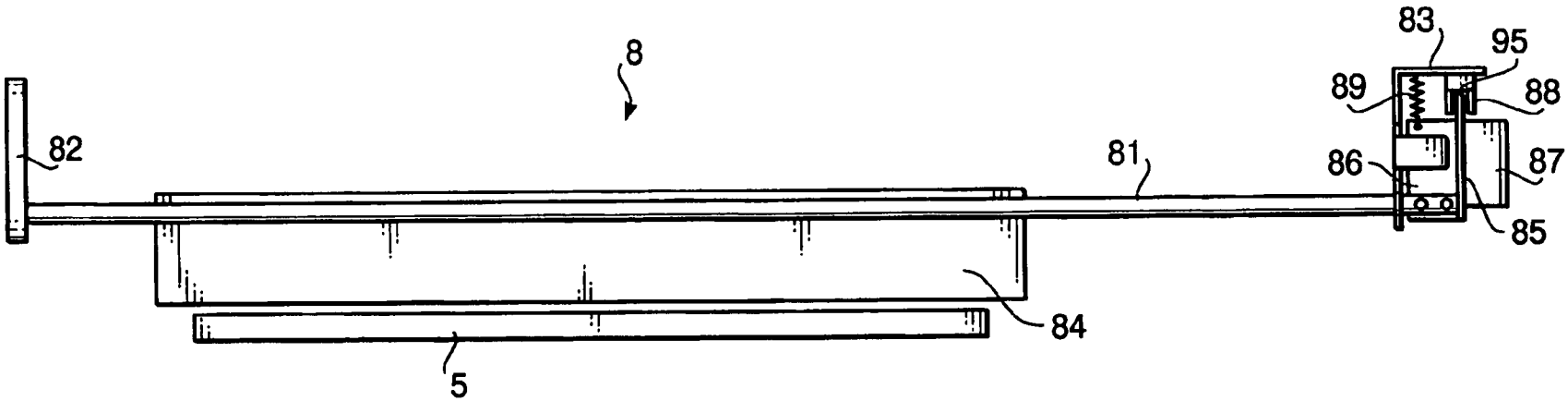
FIG. 6 is a front view of the clearance sensor system of the inkjet printer according to the first embodiment of the invention.
Figure 7:
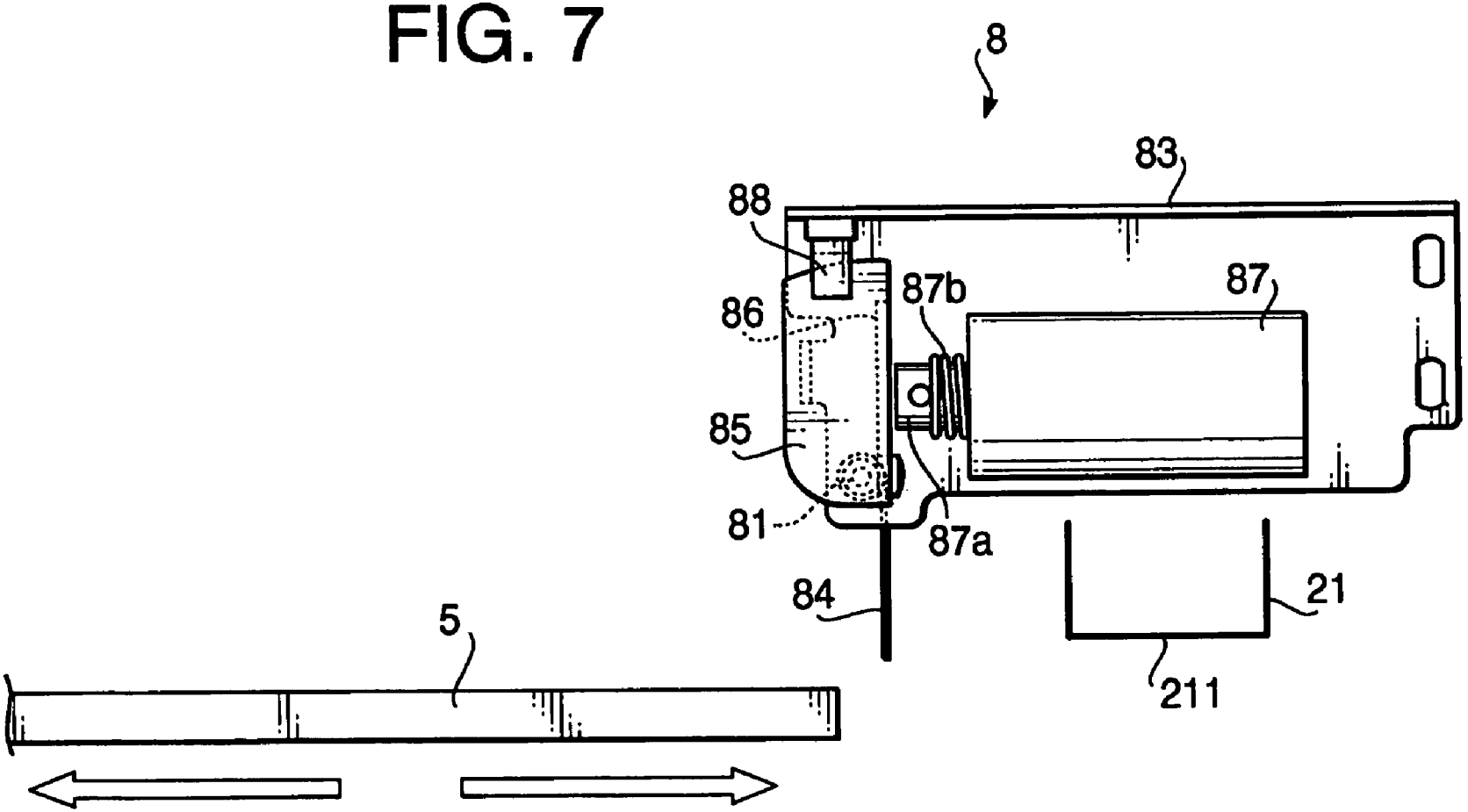
FIG. 7 is a side view of the clearance sensor system of the inkjet printer according to the first embodiment of the invention.
Figure 8:
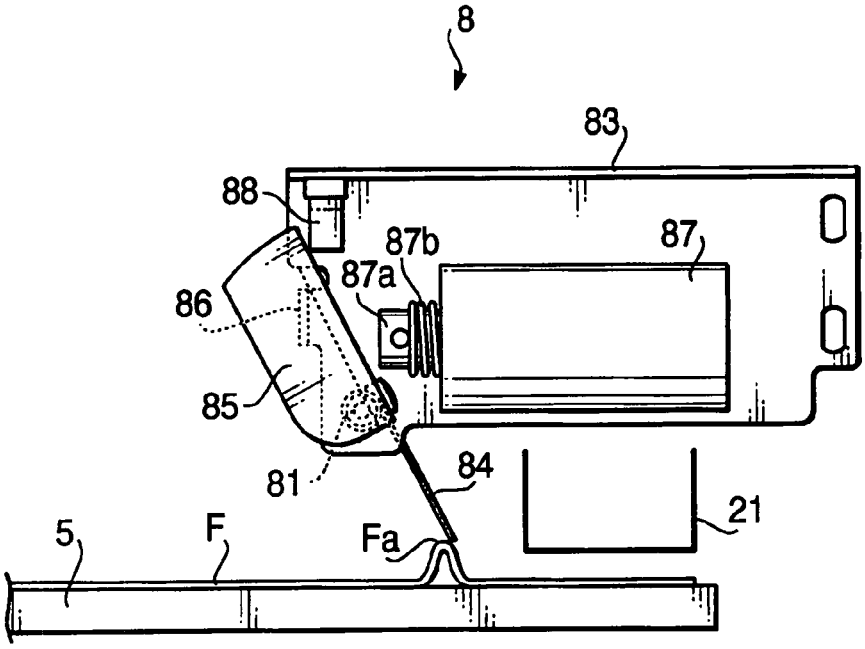
FIG. 8 is an illustrative side view of the inkjet printer with an obstacle on a recording medium according to the first embodiment of the invention.

Next, referring to FIGS. 5-8, a configuration of the clearance sensor system 8 will be described in detail. FIG. 5 is a perspective view of the clearance sensor system 8 of the inkjet printer 1 according to the embodiment of the invention. FIG. 6 is a front view of the clearance sensor system 8 of the inkjet printer 1 according to the embodiment of the invention. FIG. 7 is a side view of the clearance sensor system 8 of the inkjet printer 1 according to the embodiment of the invention. FIG. 8 is an illustrative side view of the inkjet printer 1 with an obstacle Fa on a recording medium according to the embodiment of the invention.

As shown in FIGS. 5 and 6, in the clearance sensor system 8, a shaft 81, which is extended between the right-hand side and the left-hand side of the chassis 2, is rotatably supported by a supporting member 82 and a supporting base 83. The supporting member 82 is fixed to the left-hand end of the cassis 2 while the supporting base 83 is fixed to the right-hand end of the chassis 2. The shaft 81 is arranged in a position above the platen 5 being fed and in a direction perpendicular to a feeding direction (i.e., the front-rear direction) of the platen 5. Further, the shaft 81 is arranged in parallel with the surface of the platen 5. Furthermore, the shaft 81 is arranged in parallel with the guide rail 9 and in near front of the guide rail 9 in a plane view.

The shaft 81 is provided with a blade 84, which hangs downward from the shaft 81. The blade 84 has a shape of an approximate rectangle with a longer side thereof being in parallel with the shaft 81. The length of the blade 84 is configured to be substantially greater than a width of the platen 5 in the right-left direction. The blade 84 is arranged in a position upstream of the feeding direction of the platen 5 with respect to the carriage 20 being carried and above the platen 5. More specifically, as shown in FIG. 7, the blade 84 hangs vertically from the shaft 81 when the platen 5 is directly under the blade 84, and a clearance between a lower end of the blade 84 and the upper surface of the platen is separated for a range which is approximately from 3.7 mm to 4.2 mm. The lower end of the blade 84 is in a position approximately 0.5 mm closer to the platen 5 from front ends of the nozzle surfaces 211 of the inkjet heads 21. In this position, the lower end of the blade 84 is in a range between the front ends of the nozzle surfaces 211 and the upper surface of the platen 5.

It should be noted that the position of the blade 84 as described above can be determined based on thickness of the fabric F as the recording medium and a preferable distance between the nozzle surfaces 211 of the inkjet heads 21 and the recording medium, which has been derived from various experiments and researches. However, the position of the blade 84 is not limited to the position as described above and can be modified depending on the recording medium used in the inkjet printer 1.

When the platen 5 with the fabric F set thereon is fed under the blade 84 configured as above, and if there is an obstacle Fa such as dust and a crease on the fabric F, the blade 84 is interfered by the obstacle Fa. It should be noted that the blade 84 is configured to be rotated by force of the platen 5 being fed about an axis of the shaft 81 as the blade 84 becomes in contact with such an obstacle Fa.

The supporting base 83 fixed to the left-hand end of the chassis 2 is provided with the interceptive plate 85 on the right-hand end of the shaft 81. The interceptive plate 85 has a shape of an approximate rectangle and is positioned perpendicularly to the shaft 81. The two surfaces of the interceptive plate 85 are parallel to the front-rear direction of the chassis 2, and in the front view of the inkjet printer 1, longer sides of the interceptive plate 85 is aligned in parallel to the vertical direction of the inkjet printer 1 (see FIG. 6). The shaft 81 is fixed to a lower end of the interceptive plate 85. A direction in which the blade 84 hangs down and the surfaces of the interceptive plate 85 are aligned at an angle of 180 degrees about an axis of the shaft 81.

An upper end portion of the interceptive plate 85 is contactlessly inserted in the concave portion 95 of the sensor 88, which is open downwardly, and intercepts the light transmitted therein. The sensor 88 detects existence of the interceptive plate 85 as the light transmitted between the light emitting unit and the light receiving unit of the concave portion 95 is intercepted by the interceptive plate 85 and detects absence of the interceptive plate 85 as the light from the light emitting unit is transmitted to the light receiving unit without being blocked by the interceptive plate 85.

At the right-hand side of the shaft 81, a receiver plate 86, which extends in FIG. 7 in a direction at an angle of 180 degrees about the axis of the shaft 81 with respect to the direction wherein the blade 84 hangs down, is provided. The receiver plate 86 has a shape of an approximate rectangle, which extends in the vertical direction from the shaft 81 and is positioned perpendicularly to the interceptive plate. The receiver plate 86 is fixed to a spring 89 at one end thereof (see FIG. 5 and 6). The other end of the spring 89 is fixed to the supporting base 83. With a contracting effect of the spring 89, the receiver plate 86 is maintained to be in a vertical position extending from the shaft 81. Further, the interceptive plate 85 fixed to the receiver plate 86 is maintained vertically along with the receiver plate 86, and the upper end portion of the interceptive plate 85 is inserted in the concave portion 95 of the sensor 88 so that the light emitted from the light emitting unit is blocked. Furthermore, the blade 84 is maintained vertically hanging downward from the shaft 81.

The solenoid 87 is provided to the supporting base 83 in a rear side of the receiver plate 86. The solenoid 87 converts electric energy to linear motions by utilizing magnetic actions caused by electrical current generated in a coil so that a protrusive portion 87*a* to be expanded and contracted in the front-rear direction. The protrusive portion 87*a* has a spring 87*b* that coils around an outer periphery of the protrusive portion 87*a*. With the spring 87*b*, the protrusive portion 87*a* is maintained extended in the front direction of the chassis 2 when the solenoid 87 is inactivated.

As the solenoid 87 is activated, the protrusive portion 87*a* is contracted in the rear direction of the chassis 2 (toward a right-hand side in FIG. 7) so that a protruded portion of the protrusive portion 87*a* is shortened. When a printing operation is executed while the solenoid 87 is activated, the protrusive portion 87*a* is released from the contraction. Therefore, the protrusive portion 87*a* returns to be extended toward the front of the chassis 2 by the expanding effect of the spring 87*b*.

As the protrusive portion 87*a* of the solenoid 87 is extended, the protrusive member becomes in contact with a rear surface of the receiver plate 86 so that the receiver plate 86 is pressed toward the front of the chassis 2. Thus, as shown in FIG. 8, the receiver plate 86 is rotated about the axis of the shaft 81. As the receiver plate 86 is rotated, the interceptive plate 85 being fixed to the receiver plate 86 is rotated about the axis of the shaft 81 as well while the blade 84 extending in the opposite direction (at the angle of 180 degrees) from the receiver plate 86 is rotated about the axis of the shaft 81 toward the rear of the chassis 2.

With the configuration as described above, the protrusive portion 87*a* of the solenoid 87 is shortened when an obstacle Fa on the fabric F is detected by the clearance sensor system 8 so that the blade 84 is maintained hanging vertically from the shaft 81. When the clearance sensor system 8 is not activated to detect an obstacle Fa, the protrusive portion 87*a* of the solenoid 87 is extended toward the front of the chassis 2 so that the blade 84 is rotated about the axis of the shaft 81 toward the rear of the chassis 2. It should be noted that when the blade 84 is hanging vertically from the shaft 81, the light emitted from the light emitting unit in the concave portion 95 of the sensor 88 is blocked by the interceptive plate 85, and thus it is determined that no obstacle such as a crease or dust is detected on the fabric F. When the light emitted from the light emitting unit in the concave portion 95 of the sensor 88 is not blocked by the interceptive plate 85 and transmitted to the light receiving unit, it is determined that an obstacle Fa on the fabric F is detected.

Figure 9:
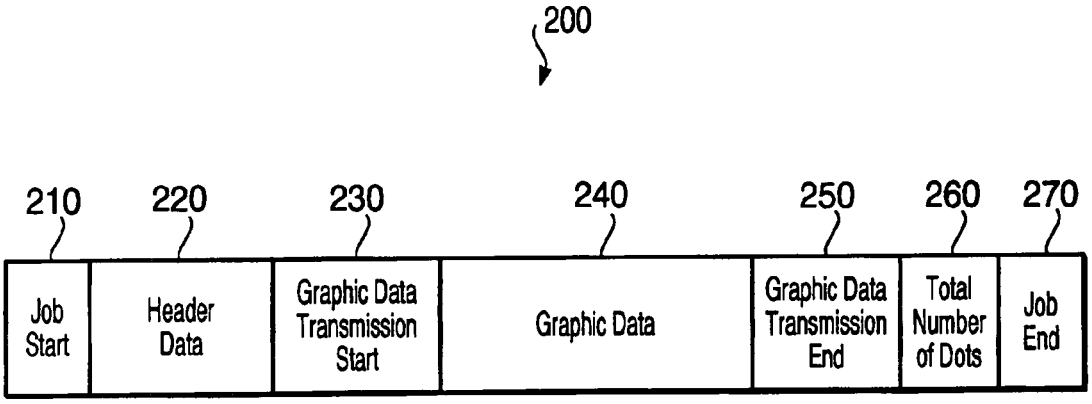
FIG. 9 illustrates a configuration of print data according to the first embodiment of the invention.
Figure 10:
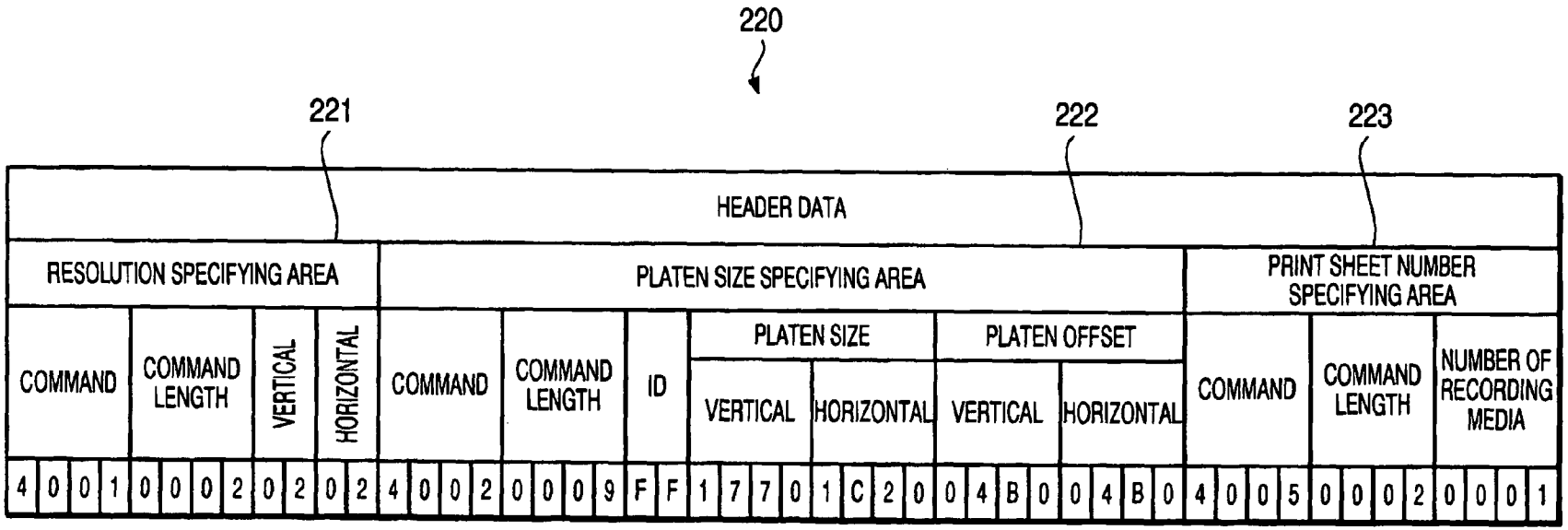
FIG. 10 illustrates a detailed configuration of header data of the print data according to the first embodiment of the invention.
Figure 11:
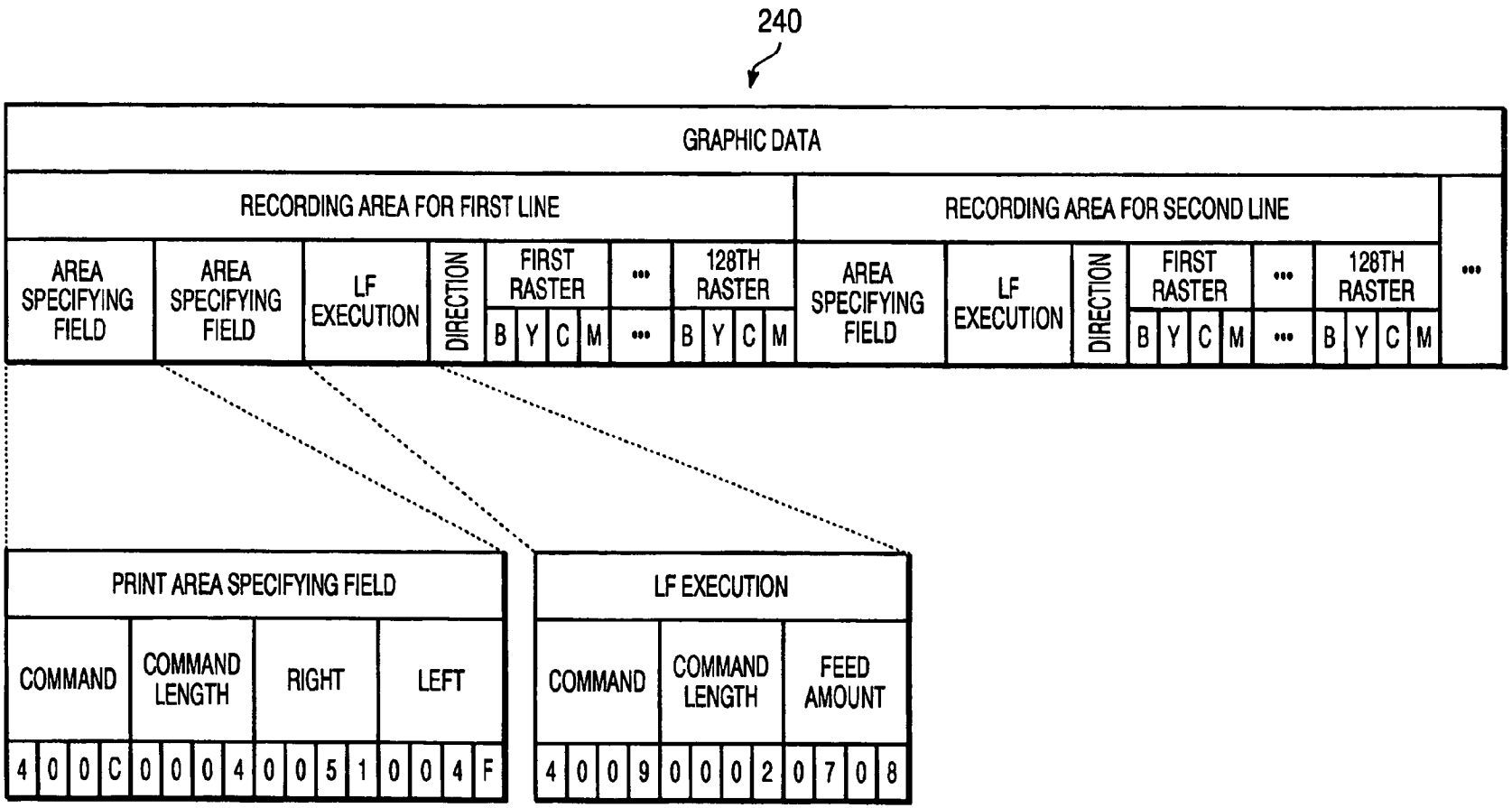
FIG. 11 illustrates a detailed configuration of graphic data of the print data according to the first embodiment of the invention.

Next, referring to FIGS. 9-11, print data 200 used in the inkjet printer 1 for printing will be described in detail. The print data 200 is generated in the PC 90 and transmitted to the inkjet printer 1, which executes a printing operation by controlling the head drive unit 140 and the motor drive unit 145 based on information included in the print data 200. FIG. 9 illustrates a configuration of the print data 200 according to the embodiment of the invention. FIG. 10 illustrates a detailed configuration of header data 220 of the print data 200 according to the embodiment of the invention. FIG. 11 illustrates a detailed configuration of graphic data 240 of the print data 200 according to the embodiment of the invention.

Hereinafter, referring to FIG. 9, an entire configuration of the print data 20 will be described. As shown in FIG. 9, the print data 200 includes pieces of data that are job start 210, header data 220, graphic data transmission start 230, graphic data 240, graphic data transmission end 250, total number of dots 260, and job end 270.

The job start 210 includes a character string indicating a beginning of the print data 200. The header data 220 includes information regarding a suitable type or size of the platen 5 to be used with the print data 200. The header data 220 will be described hereinbelow referring to FIG. 10. The graphic data transmission start 230 includes a character string indicating that the graphic data 240 to control the 128 channels of each inkjet head 21 will follow thereafter. The graphic data transmission end 250 includes a character string indicating the end of the graphic data 240, which will be described in detail hereinbelow with reference to FIG. 11. The total number of dots 260 includes information regarding a total number of dots of each ink (cyan, magenta, yellow, black). The job end 270 includes a character string indicating the end of the print data. Each information included in the pieces of data is indicated in hexadecimal.

Next, referring to FIG. 10, the header data 220 will be described. The header data 220 includes a resolution specifying area 221, a platen size specifying area 222, and a print sheet number specifying area 223. A beginning of each area is provided with a command field specifying the area wherein the field is included, and a command length field, which indicates a length (i.e., a number of bytes) of information regarding the command. The information with the length indicated in the command length field follows thereafter.

In the resolution specifying area 221, a vertical length field, wherein a height of the resolution is indicated, and a horizontal length field, wherein a width of the resolution is indicated, are included. In FIG. 10, a command "@1" is indicated in hexadecimal (i.e., "4001"). A length of the command is 4 bytes. The vertical length and the horizontal length of the resolution are respectively 2, which indicates 600 dpi (dot per inch) in the present embodiment. The platen size area 222 is provided with an ID field, a platen size (vertical) field, a platen size (horizontal) field, a platen offset (vertical) field, and a platen offset (horizontal) field, in addition to a command field and a command length field. The platen size (vertical) field includes information regarding a suitable vertical length of the platen 5 to be used with the print data 200. The platen size (horizontal) field includes information regarding a suitable horizontal length of the platen 5 to be used with the print data 200. The platen offset fields include information regarding vertical and horizontal offset amounts in a platen to be referenced (a reference platen 50, see FIG. 13) as a criterial platen for the inkjet printer 1. A platen size and offset amounts of the platen 5, which is previously registered in the inkjet printer 1, are stored in the platen information table storing area 121 of the ROM 120, therefore, merely the ID field may be filled in with a code indicating the platen 5.

The information regarding the platen 5 with an ID is stored in the platen information table storing area 121 of the ROM 120. The platen information table storing area will be described hereinbelow with reference to FIG. 12. The inkjet printer 1 has the reference platen 50 registered so that differences in vertical and horizontal sizes between the platen 5 to be used with the print data 200 and the reference platen 50 are contained in the platen offset fields. In FIG. 10, the command "@2" which indicates "4002" in hexadecimal is contained in the command field of the platen size area 222, and the command length is indicated as 9 bytes. In the ID fields, "FF" indicating no ID for the platen to be used is set is contained. In the platen size (vertical) field, "1770" indicating 6000 pixels is contained, while "1C20" indicating 7200 pixels is contained in the platen size (horizontal) field. In each of the platen offset (vertical) field and the platen offset (horizontal) field, "04B0" indicating 1200 pixels is contained respectively.

In the print sheet number specifying area 223, a number of the recording media to be printed is contained. In FIG. 10, the command "@5" which indicates "4005" in hexadecimal is contained in the command field of the print sheet number specifying area 223, and the command length is indicated as 2 bytes. "1" as the number of the recording media to be printed is included in a sheet number field.

Next, referring to FIG. 11, the graphic data 240 will be described in detail. As shown in FIG. 11, the graphic data 240 contains a recording area for each line, graphic data to control the 128 channels of each inkjet head 21, and amounts and directions to drive the platen drive motor 7. In a first line as a recording area, two area specifying fields, an LF (line feed) execution field, a direction field, and a first through 128th raster fields are contained. The area specifying fields are provided with a command field, a command length field, a right field and a left fields. As shown in FIG. 11, the command "@c" which indicates "400C" in hexadecimal is contained in the command field of the area specifying field of the graphic data 240, and the command length is indicated as 4 bytes.

In the area specifying field, an area to be printed on the platen 5 is specified. The area specifying commands include information regarding each line to be printed. It should be noted that each area specifying command includes information regarding a line that follows thereafter. That is, in the two recording areas of the first line, information regarding the first line and the second line is contained respectively, while the recording area of the second line includes information regarding a third line. The offset amount included in the right field indicates a length between a right end of the platen and a right end of the area (line) to be printed. Similarly, the offset amount included in the left field indicates a length between a left end of the platen and a left end of the area (line) to be printed. It should be noted that the platen mentioned here is not a platen to be actually used, but a virtual platen of which a horizontal length is multiples of 32 for a purpose of processing the data in higher speed. In FIG. 11, the right field contains "0051", which indicates 648 pixels. The left field contains "004F", which indicates 632 pixels. In the present embodiment, a horizontal length of the virtual platen is "6080". "32" pixels as a multiple of 32 are added to the right end and the left end of "6000" as a preferable horizontal length of the platen respectively ("32+6000+32"), and 16 pixels, which is obtained by 32*188−6000, is added, while 188 is an integer part of a quotient of (6000+31)/32 (i.e., the horizontal length of the virtual platen is derived from an equation; 32+6000+32+16=6080).

In the LF execution field, a command field, a command length field, and a feed amount field are provided. The command "@9" which indicates "4009" in hexadecimal is contained in the command field of the LF execution field of the graphic data 240, and the command length is indicated as 2 bytes. Further, the feed amount "0708", which indicates 1800 pixels, is contained in the feed amount field. The feed amount indicates a length between a front end of the reference platen 50 (a side of the reference platen 50 oriented toward the rear side in the inkjet printer 1) and a record starting position wherein the printing is started. In the present embodiment, a position at a length corresponding to 1800 pixels (3 inches when the printing resolution is 600 dpi) from the front end of the reference platen 50 is the record starting position. When no LF execution field is provided to the recording area, it indicates that the printing starts from the front end of the platen.

In each of the direction field and the first through 128th raster fields that follow the LF execution field, a command field (not shown) and a command length field (not shown) are similarly provided. In the first raster field, raster data for each color (i.e., K (black), Y (yellow), C (cyan), and M (magenta)) as information regarding a first channel of the inkjet head 21 is contained. Further, up to the 128th raster field, information regarding a channel of the inkjet head 21 is contained in each raster field. Similarly, up to a last line of the print data, information regarding the recording area of each line follows.

Next, referring to FIG. 12, the platen information table storing area 121 will be described in detail. The platen information table storing area 121 is provided in the ROM 120, and the information regarding the platen 5 with an ID is stored therein. The information regarding the platen 5 includes a size of the platen 5 and offset amounts with respect to the reference platen 50. As shown in FIG. 12, the platen information table storing area 121 contains a platen type field, an ID field, a size (horizontal) field, a size (vertical) field, an offset (horizontal) field, and an offset (vertical) field. In the present embodiment, in the platen type field, information regarding a type of the platen, which is "large" or "small", is contained. An ID for the "large" platen is "0", and a horizontal length of the large platen is 14 inches, a vertical length is 16 inches, offset amounts with respect to the reference platen 50 in the horizontal direction are respectively 0 inch, and offset amounts in the vertical direction are also 0 inch. That is, a size of the large platen is substantially same as the size of the reference platen 50. An ID for the "small" platen is "1", and a horizontal length of the small platen is 10 inches, a vertical length is 12 inches, offsets amounts with respect to the reference platen 50 in the horizontal direction are respectively 2 inches, and offset amounts in the vertical direction are also 2 inches.

Figure 13:
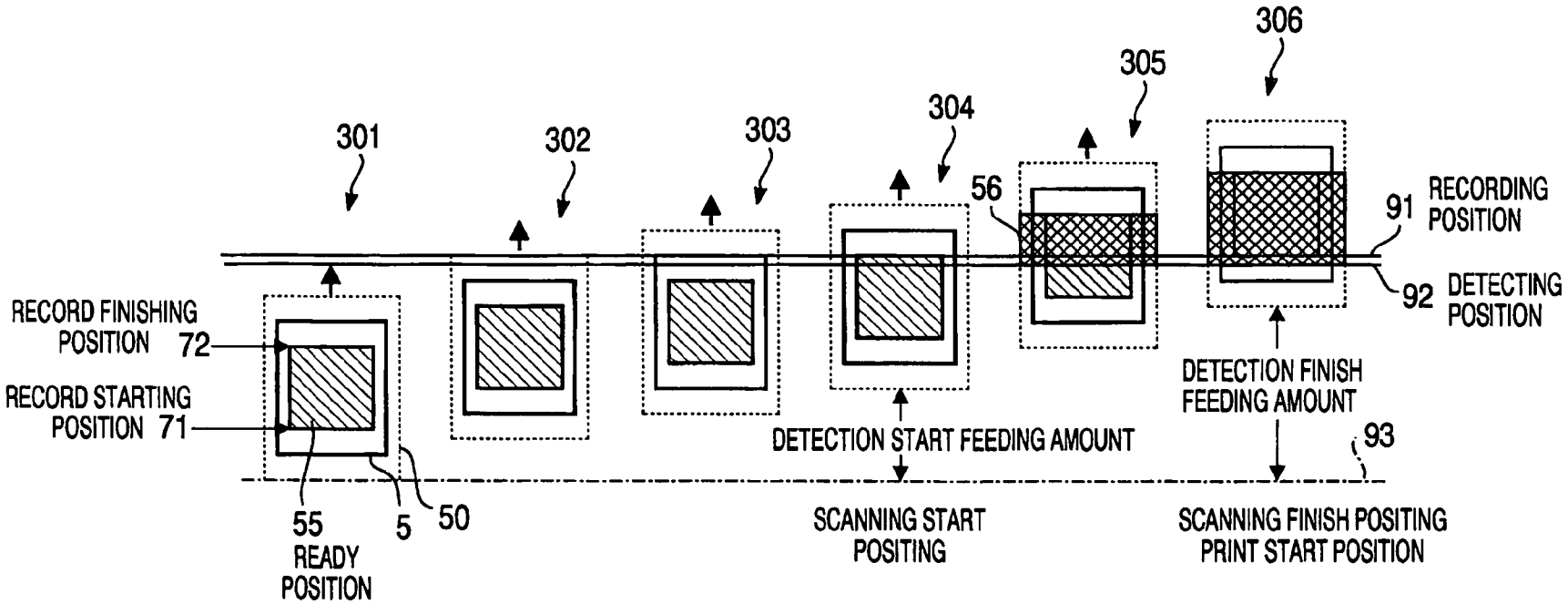
FIG. 13 illustrates movement of the platen being driven according to the first embodiment of the invention.
Figure 14:
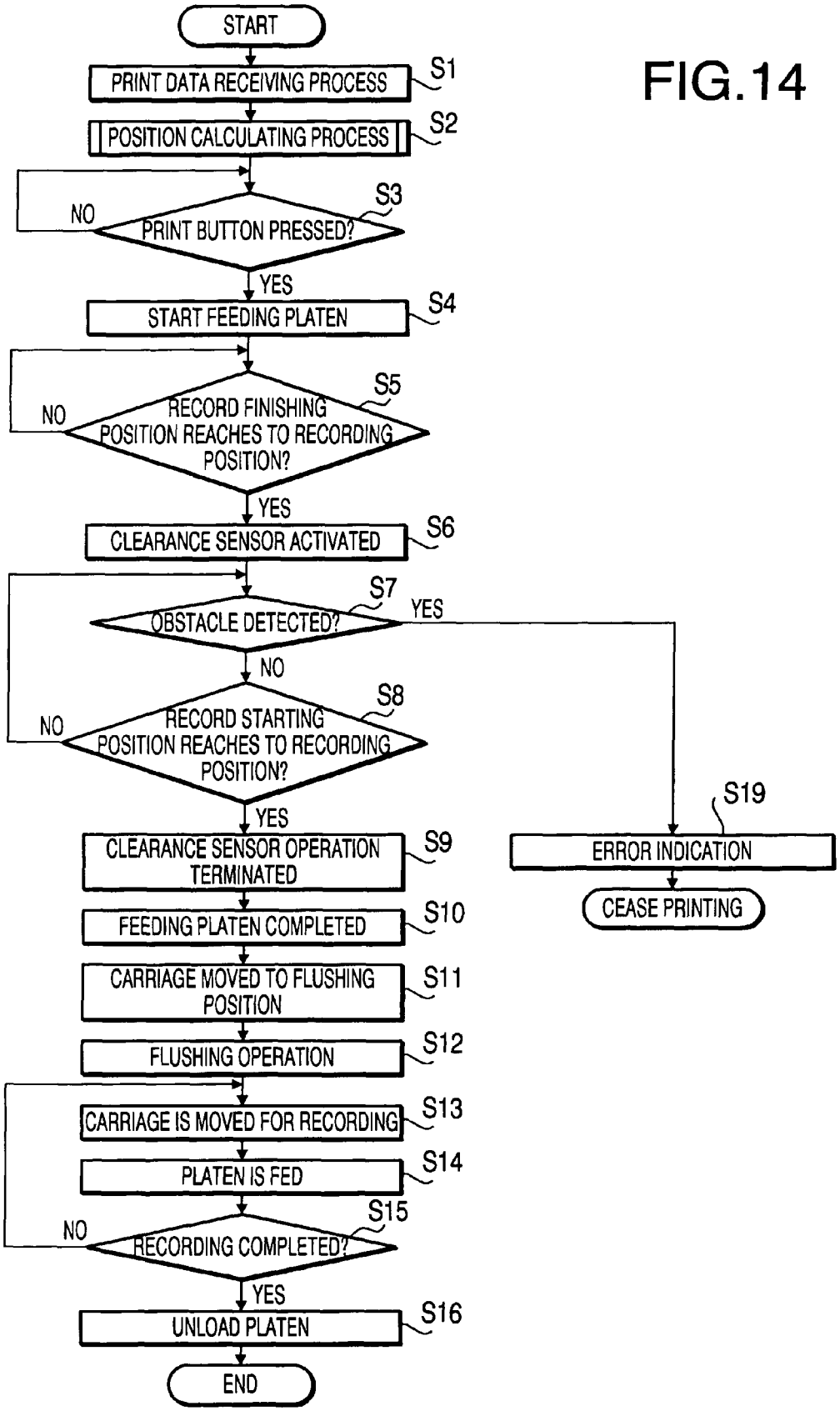
FIG. 14 is a flowchart of a controlling process of the inkjet printer when the print data is received by a CPU of the inkjet printer according to the first embodiment of the invention.

Next, referring to FIGS. 13-15, an operation to detect an obstacle Fa on the fabric F as the recording medium performed by the clearance sensor system 8 will be described. FIG. 13 illustrates movement of the platen 5 being carried according to the embodiment of the invention. It should be noted an upper side in FIG. 13 corresponds to the upstream side of the feeding direction of the platen 5 and to the rear-end side of the rails 3 in FIG. 1, while a lower side in FIG. 13 corresponds to the downstream side of the feeding direction of the platen 5 and to the front-end side of the rails 3 in FIG. 1.

As shown in FIG. 13, the platen 5 is carried sequentially from an operating state (a ready position) 301 to an operating state 306 through operating states 302, 303, 304, 305 from the downstream side toward the upstream side (i.e., from the lower side toward the upper side in FIG. 13). Rectangles with solid lines in the operating states 301-306 indicate positions of the platen 5 in a plan view. Rectangles with dotted lines that are substantially larger than the rectangles indicating the platen 5 in the operating states 301-306 indicate positions of the reference platen 50 in a plane view. It should be noted that a center of the platen 5 and a center of the reference platen 50 coincide with each other. Diagonally shaded areas inside the platen 5 are print objective areas 55 wherein printing is applied. Gridded areas in the operating states 305, 306 indicate examined areas 56, wherein scanning by the clearance sensor system 8 was completed. A lower side of the print objective area 55 in the platen 5 corresponds to a record starting position 71, and an upper side of the print objective area 55 corresponds to a record finishing position 72. The record starting position 71 and the record finishing position 72 are shifted as the platen 5 is carried.

Before a printing operation starts, the platen 5 in the operating state 301 stands by in the ready position. As the printing operation starts, the platen 5 is carried toward the upstream side. When the platen 5 is in the operating state 304, the platen 5 is in a scanning start position of the platen 5 wherein the clearance sensor system 8 starts scanning. Further, when the platen 5 is in the operating state 306, the platen 5 is in a scanning finish position, wherein the clearance sensor system 8 finishes scanning. The platen 5 in the scanning finish position is also in a print starting position, wherein the record starting point 71 and the recording position 91 correspond. When the platen 5 is carried to the print start position, the direction to carry the platen 5 from the downstream side to the upstream side is turned in the other way to carry the platen 5 from the upstream side to the downstream side as recording proceeds.

An upper line of two horizontal lines drawn in a center in FIG. 13 indicates a recording position 91, wherein the carriage 20 with the inkjet heads 21 is moved. A lower line indicates a detecting position 92, wherein the shaft 81 of the clearance sensor system 8 is arranged. In FIG. 13, the recording position 91 and the detecting position 92 are substantially separated for a visualizing purpose, however, a recording path of the inkjet heads 21 on the platen 5 and the shaft 81 of the clearance sensor system 8 are practically arranged in adjacent to each other. A dashed line arranged in the down stream side from the detecting position 92 indicates a reference ready position 93, which corresponds to the lower end of the reference platen 50 when the reference platen 50 is in the ready position.

As shown in FIG. 13, the platen 5 in the ready position (i.e., in the operating state 301) is carried toward the upstream side transitioning through the operating states 302, 303. When the platen 5 is carried further and brought in the operating state 304, wherein the record finishing position 72 corresponds to the recording position 91, the protrusive portion 87*a* of the solenoid 87 in the clearance sensor system 8 is contracted so that the blade 84 hangs vertically from the shaft 81, and scanning starts. As the platen 5 is further carried toward the upstream side, the clearance sensor system 8 scans an upper portion of the print objective area 55, and the examined area 56 is created as shown in the operating state 305. Further, when the lower end of the print objective area 55 is brought to the recording position 91, an entire print objective area 55 has been scanned. Therefore, scanning is terminated and the platen 5 being carried stops. Thereafter, the platen 5 is carried toward the downstream side, and recording starts.

Next, referring to FIGS. 14 and 15, controlling processes of the CPU 11 of the inkjet printer 1 as the inkjet printer 1 receives the print data from the PC 90 will be described in detail. FIG. 14 is a flowchart of a controlling process of the inkjet printer 1 according to the embodiment of the invention. FIG. 15 is a flowchart of a position calculating process of the inkjet printer 1 according the embodiment of the invention.

When the process starts, in S1, a print data receiving step is executed. In this step, the print data received from the PC 90 is stored in the print data storing area 131 of the RAM 130. Next, in S2, the position calculating process is executed. In this process, a position wherein the clearance sensor system 8 is activated (i.e., an amount to carry the platen 5 before the clearance sensor system 8 is activated) is calculated.

Figure 15:
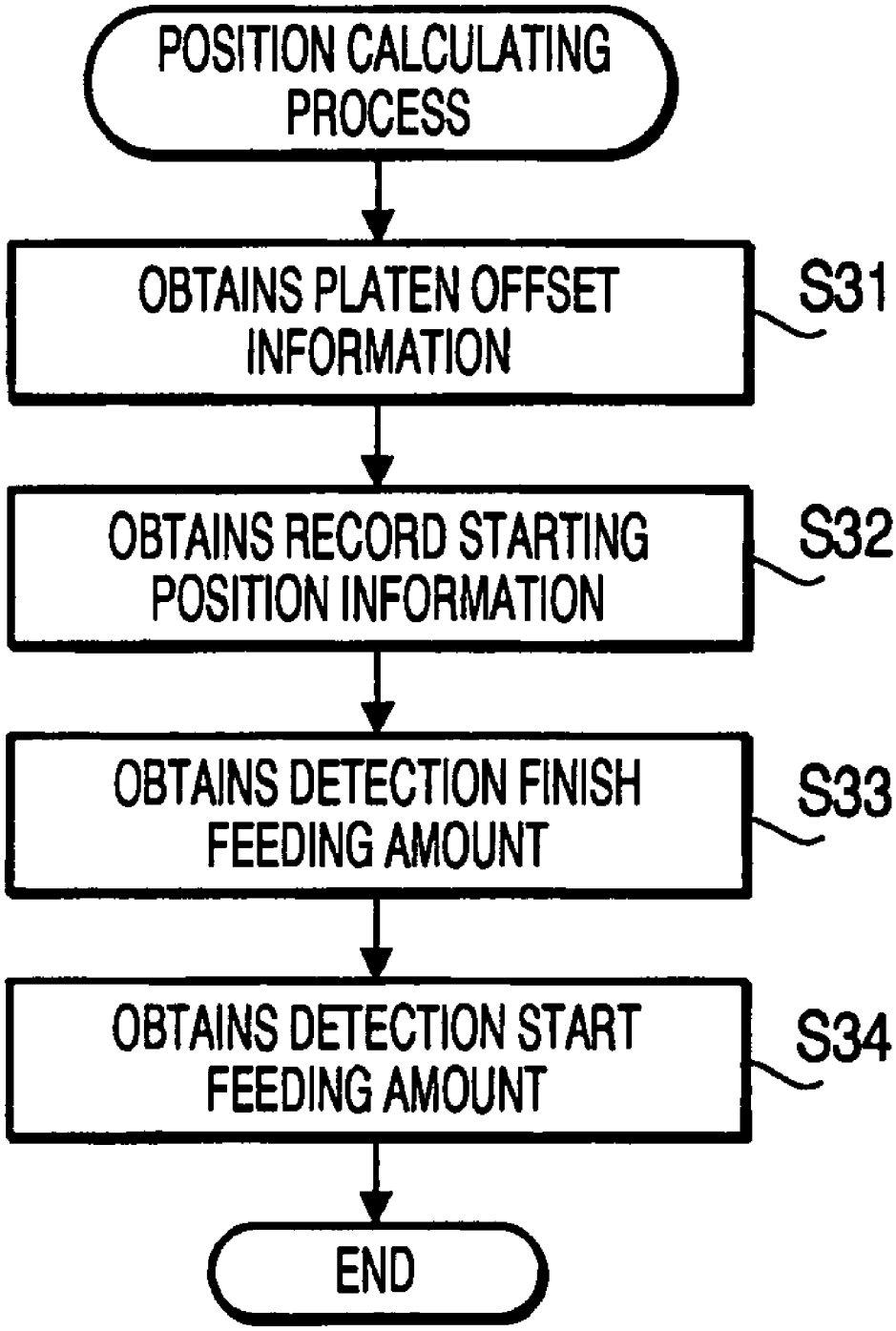
FIG. 15 is a flowchart of a position calculating process of the inkjet printer according the first embodiment of the invention.

In the position calculating process, as shown in FIG. 15, the CPU 11 obtains platen offset information (S31). In this step, more specifically, a value in the platen offset (vertical) field of the platen size area 222 in the header data 220, which is included in the print data 200, is obtained from the print data storing area 131. When no value is included in the platen size fields and the platen offset fields in the platen size area 222, but an ID for the platen 5 is included in the ID field, information (a value) regarding offset amounts for the ID included in the ID field is obtained from the offset (vertical) field in the platen information table storing area 121 of the ROM 120. The obtained value is divided by a resolution specified in the vertical length field of the resolution specifying area 221, and the divided result is stored in the platen offset information storing area 132 of the RAM 130 as the platen offset information. The platen offset information indicates a difference between the lower end of the platen 5 and the lower end of the reference platen 50. That is, the difference obtained as above is a half of a difference between the platen 5 and the reference platen 50 in the vertical direction. In the example shown in FIGS. 10 and 11, the offset amount for the platen 5 is 1200 pixels, and the resolution is 600 dpi, therefore, 2 inches as the offset information is obtained.

Next, in S32, the record starting position information is calculated. The value in the feed amount field of the LF execution field for the first line in the graphic data 240 is divided by the resolution specified in the vertical length field of the resolution specifying area 221 in the header data 220. The obtained value is stored in the record starting position information storing area 133 of the RAM 130 as the record starting position information. The record starting position information indicates a length from the lower end of the platen 5 and the lower end of the print objective area. In the example shown in FIGS. 10 and 11, the feed amount is 1800 pixel, and the resolution is 600 dpi, therefore, 3 inches as the feed amount is obtained. When no LF execution field is included in the first line, and recording starts from the upper end of the platen 5, the feed amount is set to 0.

Next, in S33, a detection finish feeding amount is calculated. In this step, first, the value indicating the record starting position information obtained in S32 is added to the value indicating the platen offset information obtained in S31. Thereafter, a length between the lower side of the reference platen being in the ready position and the lower side of the reference platen 50 being in a reference record starting position, wherein the lower side of the reference platen 50 is in the print start position, (a reference feeding amount) is obtained from the reference feeding amount storing area 122 of the ROM 120. The reference feeding amount is determined by the size of the reference platen 50 and the ready position of the inkjet printer 1. Therefore, the inkjet printer 1 is provided with a single value as the reference feeding amount, which is stored in the reference feeding amount storing area 122 of the ROM 120. Next, the value as the platen offset information and the value as the record starting position information are subtracted from the reference feeding amount. The subtracted value is stored in the detection finish feeding amount storing area 134 of the RAM 130 as the detecting feeding amount, which is an amount of the reference platen 50 to be carried to the scanning finish position (i.e., the print start position) from the ready position. In the present embodiment, when the reference feeding amount is 18 inches, the value as the platen offset information is 2 inches and the value as the record starting position information is 3 inches, which make the detection finish feeding amount 13 inches.

Next, in S34, a detection start feeding amount is calculated. In this step, each value in all of the LF execution fields in the graphic data of the print data 200 is summed. The obtained sum indicates total line feeds in the printing operation. The sum is added to a value indicating a height (a vertical length) of a line formed with the ejected ink along the sub-scanning direction of the inkjet head 21, and the added value represents a vertical length of the print objective area. It should be noted that the vertical length of the print objective area can be obtained by the above-described calculation when the height of a line is equal to a height of a line feed. When each line is formed to partially overlap with another line, the vertical length of the print objective area is obtained by calculating in consideration of the overlapped portions. Thereafter, the detection start feeding amount is obtained by subtracting the vertical length of the print objective area from the detection finish feeding amount obtained in S33 and is stored in the detection start feeding amount storing area 135 of the RAM 130.

Thus, as the position calculating process completes in S2, it is judged as to whether the print button 281 is pressed in S3. In S3, the inkjet printer 1 awaits until the print button 281 is pressed (S3: NO). When the print button 281 is pressed (S3: YES), in S4, the inkjet printer 1 starts feeding the platen 5. In this step, the platen 5 is carried for an amount as the detection start feeding amount stored in the detection start feeding amount storing area 135. When the record finishing position 72 reaches to the recording position 91, that is, the platen 5 is in the operating state 304 as shown in FIG. 13 (S5:YES), in S6, the clearance sensor system 8 is instructed to contract the protrusive portion 87*a* of the solenoid 87 so that the blade 84 hangs vertically from the shaft 81, and scanning starts. Next, in S7, it is judged as to whether the clearance sensor 8 detects an obstacle Fa such as dust and a crease. When the light emitted from the light emitting unit in the sensor 88 is transmitted to the light receiving unit (S7: YES), it is determined that an obstacle Fa on the fabric F is detected. Therefore, in S19, an error is indicated in the operation panel 28 by for example switching on an error lamp, and the printing operation is ceased.

When no obstacle is detected by the clearance sensor system 8 (S7: NO), in S8, the platen 5 is carried for a length corresponding to the detection finish feeding amount stored in the detection finish feeding amount storing area 134. Further, it is judged as to whether the record starting position 71 reaches to the recording position 91. If the record starting position 71 is not reached to the recording position 91 yet (S8: NO), the process returns to S7. If no obstacle is detected until the record starting position 71 reaches to the recording position 91 (S8: YES), in S9, the contraction of the protrusive portion 87*a* of the solenoid 87 in the clearance sensor system 8 is ceased so that the blade 84 is rotated about the axis of the shaft 81 toward the rear of the chassis 2, and detecting is terminated.

In S10, as the platen 5 has been carried to the scanning finish position, wherein the record starting position 71 of the platen 5 is brought to the recording position 91, feeding of the platen 5 is completed, and in S11, the carriage 20 is moved to a flushing position, wherein portions of ink are flushed from the nozzle surfaces 221 of the inkjet head 21. When the flushing operation is completed in S12, in S13, the carriage 20 is moved along the guide rails 9 by the carriage motor 24 for an amount corresponding to one line so that recording is executed as the inks are ejected from the nozzle surfaces 221 of the inkjet head 21 according to the values in the raster fields of the graphic data. As recording of the line is finished, in S14, the platen 5 is fed from the upstream side of the inkjet printer 1 toward the downstream side for an amount corresponding to the value in the feed amount field of the LF execution field. Next, in S15, a next command is read, and it is examined as to whether the graphic data 240 of the print data 200 is processed and the graphic data transmission end 250 is read. When the graphic data transmission end 250 has been read, it is determined that the recording is finished. If the recording is not finished (S15: NO), the process returns to S13, wherein the carriage 20 is operated for a next line. The steps from S13 through S15 are repeated until the recording is finished (S15: YES), in S16, the platen 5 is carried to the ready position, wherein the platen 5 can be unloaded. The process is terminated thereafter.

In the inkjet printer 1 of the present embodiment, when the record finishing position 72 is brought to the recording position 91, the clearance sensor system 8 starts scanning the fabric F to detect an obstacle Fa. Further, when the record starting position 71 is brought to the recording position 91, the scanning is finished, the platen 5 being carried is stopped, and recording is executed. As the fabric F on the platen 5 is scanned, the print objective area 55, in which an obstacle Fa should be detected, is exclusively scanned. Therefore, the platen 5 is not carried further toward the upstream side than the scanning finish position in the operating state 306 (see FIG. 13), so that the platen 5 can be prevented from being unnecessarily fed before the recording starts. In addition, when the fabric F as the recording medium includes an uneven portion such as a collar, a pocket, and garnishment, the uneven portion can be prevented from being scanned and detected as an obstacle Fa by the clearance sensor system 8 as long as the uneven portion is outside the print objective area 55.

Figure 16:
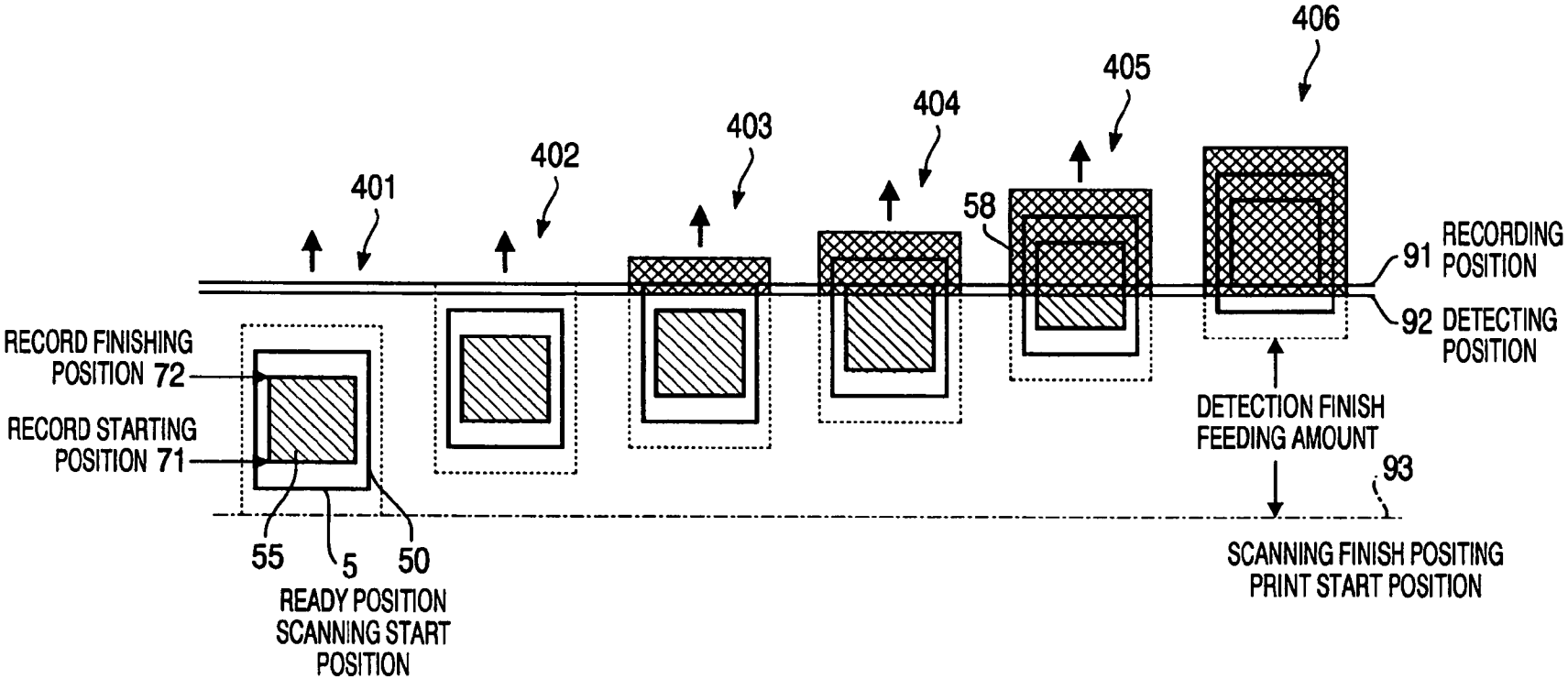
FIG. 16 illustrates movement of the platen being driven according to a second embodiment of the invention.
Figure 17:
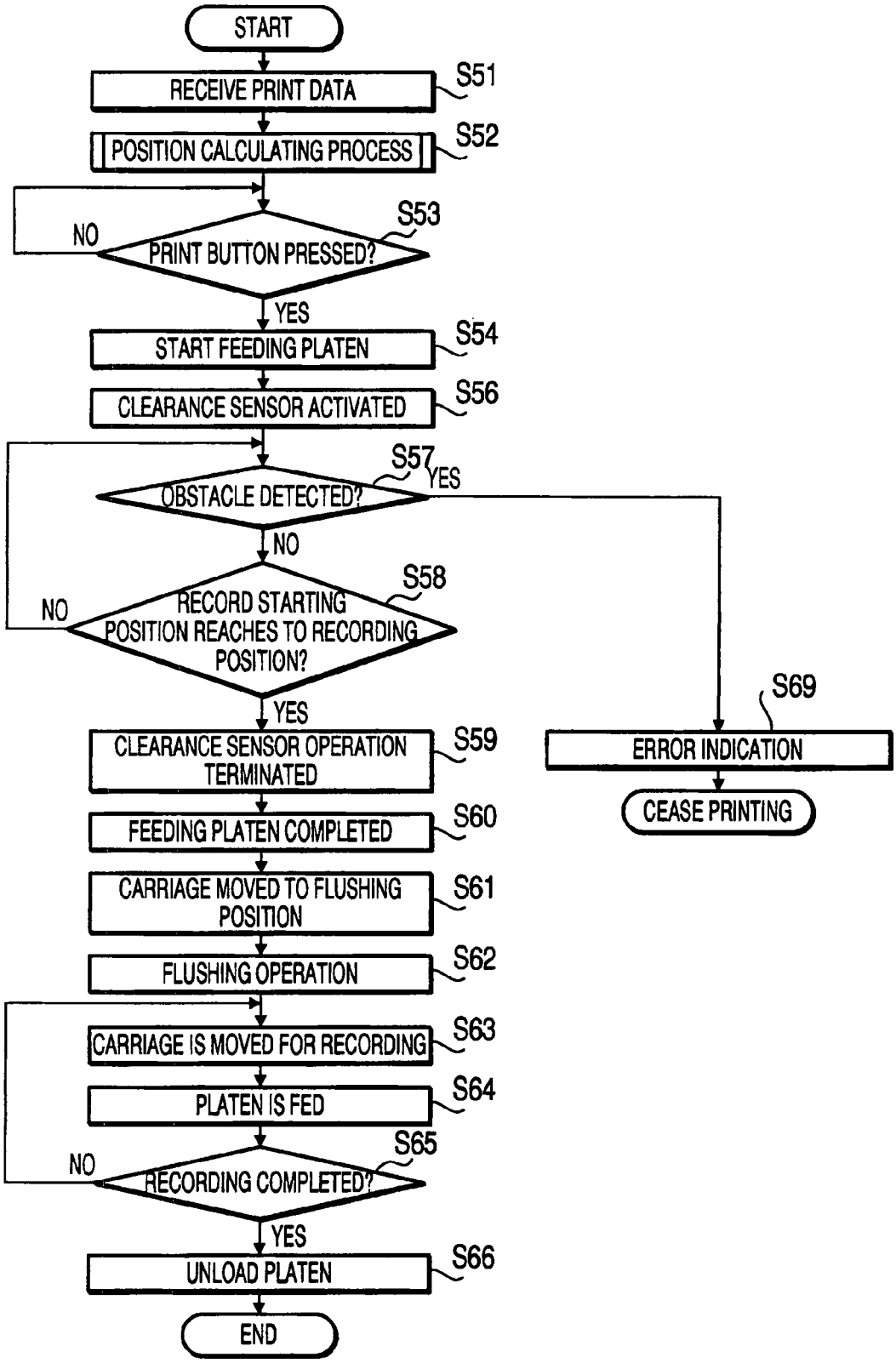
FIG. 17 is a flowchart of a controlling process of the inkjet printer when the print data is received by a CPU of the inkjet printer according to the second embodiment of the invention.

Next, referring to FIGS. 16 and 17, movement of a clearance sensor system 8 for detecting an obstacle Fa on a recording medium according to a second embodiment of the present invention will be described. In the second embodiment, a configuration of an inkjet printer 2 which is similar to the configuration of the previous embodiment is referred to by an identical reference numeral, and description of that will be omitted. A perspective view of the inkjet printer 2 according to the second embodiment of the invention is shown in FIG. 1. FIG. 16 illustrates movement of the platen 5 being driven according to the second embodiment of the invention.

As shown in FIG. 16, the platen 5 is carried sequentially from an operating state (a ready position) 401 to an operating state 406 through operating states 402, 403, 404, 405 along the rails 3 from the downstream side to the upstream side of the inkjet printer 2 (i.e., from the lower side toward the upper side in FIG. 16). Gridded areas in the operating states 405, 406 indicate examined areas 58, wherein scanning by the clearance sensor system 8 was completed.

In the previous embodiment, the protrusive portion 87*a* of the solenoid 87 in the clearance sensor system 8 is contracted as the platen 5 is in the operating state 304, wherein the record finishing position 72 corresponds to the recording position 91, so that the blade 84 hangs vertically from the shaft 81. However, in the present embodiment, as the platen 5 starts being carried, the protrusive portion 87*a* of the solenoid 87 is contracted so that the blade 84 hangs vertically from the shaft 81, and scanning starts. As the platen 5 is carried further toward the upstream side, the clearance sensor system 8 scans an upper portion of the print objective area 55, and the examined area 58 is created as shown in the operating states 403, 404, and 405. Further, when the lower end of the print objective area 55 is brought to the recording position 91, an entire print objective area 55 has been scanned. Therefore, scanning is terminated and the platen 5 being carried stops. Thereafter, the platen 5 is carried toward the downstream side, and recording starts.

Next, referring to FIG. 17, controlling processes of a CPU 110 of the inkjet printer 2 as the inkjet printer 2 receives the print data from the PC 90 will be described in detail. FIG. 17 is a flowchart of a controlling process of the inkjet printer 2 when the print data 200 is received by the CPU 110 of the inkjet printer 2 according to the second embodiment of the invention.

When the process starts, in S51, a print data receiving step is executed. In this step, the print data received from the PC 90 is stored in the print data storing area 131 of the RAM 130. Next, in S52, a position calculating process is executed. The position calculating process is executed similarly to the position calculating process described in the first embodiment (see FIG. 15), therefore, description of the process is omitted. However, it should be noted that the detection start feeding amount obtained in S34 is not used in the present embodiment.

As the position calculating process is executed, and in S52, the platen offset information, the record starting position information, and the detection finish feeding amount are obtained, next, in S53, it is judged as to whether the print button 281 is pressed. In S53, the inkjet printer 2 awaits until the print button 281 is pressed (S53: NO). When the print button 281 is pressed (S53: YES), in S54, the inkjet printer 2 starts feeding the platen 5. Next, in S56, the clearance sensor system 8 is instructed to contract the protrusive portion 87*a* of the solenoid 87 so that the blade 84 hangs vertically from the shaft 81, and scanning starts. Namely, the platen 5 is scanned from the upper side, which is the side closer to the upstream side. Next, in S57, it is judged as to whether the clearance sensor 8 detects an obstacle Fa such as dust and a crease. When the light emitted from the light emitting unit in the sensor 88 is transmitted to the light receiving unit (S57: YES), it is determined that an obstacle Fa on the fabric F is detected. Therefore, in S69, an error is indicated in the operation panel 28 by for example switching on an error lamp, and the printing operation is ceased.

When no obstacle is detected by the clearance sensor system 8 (S57: NO), in S58, the platen 5 is carried for a length corresponding to the detection finish feeding amount stored in the detection finish feeding amount storing area 134. Further, it is judged as to whether the record starting position 71 reaches to the recording position 91. If the record starting position 71 is not reached to the recording position 91 yet (S58: NO), the process returns to S57. If no obstacle is detected until the record starting position 71 reaches to the recording position 91 (S58: YES), in S59, the contraction of the protrusive portion 87*a* of the solenoid 87 in the clearance sensor system 8 is ceased so that the blade 84 is rotated about the axis of the shaft 81 toward the rear of the chassis 2, and detecting is terminated.

In S60, as the platen 5 has been carried to the scanning finish position, wherein the record starting position 71 of the platen 5 is brought to the recording position 91, feeding of the platen 5 is completed, and in S61, the carriage 20 is moved to a flushing position, wherein portions of ink are flushed from the nozzle surfaces 221 of the inkjet head 21. When the flushing operation is completed in S62, in S63, the carriage 20 is moved along the guide rails 9 by the carriage motor 24 for an amount corresponding to one line so that recording is executed as the inks are ejected from the nozzle surfaces 221 of the inkjet head 21 according to the values in the raster fields of the graphic data. As recording of the line is finished, in S64, the platen 5 is fed from the upstream side of the inkjet printer 1 toward the downstream side for an amount corresponding to the value in the feed amount field of the LF execution field. Next, in S65, it is examined as to whether the graphic data 240 of the print data 200 is processed and the graphic data transmission end 250 is read. When the graphic data transmission end 250 has been read, it is determined that the recording is finished. If the recording is not finished (S65: NO), the process returns to S63, wherein the carriage 20 is operated for a next line. The steps from S63 through S65 are repeated until the recording is finished (S65: YES), in S66, the platen 5 is carried to the ready position, wherein the platen 5 can be unloaded. The process is terminated thereafter.

In the inkjet printer 2 of the second embodiment, the clearance sensor system 8 starts scanning the fabric F to detect an obstacle Fa as the platen 5 starts being carried. Further, when the record starting position 71 is brought to the recording position 91, the scanning is finished, the platen 5 being carried is stopped, and recording is executed. Therefore, the platen 5 is not carried further toward the upstream side than the scanning finish position in the operating state 406 (see FIG. 16), so that the platen 5 can be prevented from being unnecessarily fed before the recording starts.

Although examples of carrying out the invention have been described, those skilled in the art will appreciate that there are numerous variations and permutations of the printing apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

In the embodiments described above, a preferable type or a size (i.e., the ID) is specified in the print data 200 so that the area on the recording medium to be scanned by the clearance sensor system 8 is determined by using the platen offset amount of the platen 5 specified by the ID. However, for example, the area to be scanned can be determined by using an offset amount of a platen 5 installed in the inkjet printer and of which type is detected. In such a case, the platen base is provided with a platen specifying sensor, which recognizes the type of the platen installed in the inkjet printer. The platen specifying sensor is, for example, installed in a position wherein four contact-type switches become in contact with a part of the platen 5. The platen 5, on the other hand, is provided with a projecting portion that becomes in contact with one of the contact-type switches when the platen 5 is installed in the platen base so that the position of the projecting portion can identify the type of the platen 5. In the platen information table storing area 121 of the ROM 120, a field wherein values indicating the correspondence between the contact-type switch and the projecting portion are stored is provided in addition to the fields shown in FIG. 12. For example, for the small platen with the numeral ID "1", four digit number such as "1001" is stored, while each digit of the number indicates an ON/OFF status of one of the contact-type switches. In this case, for example, a first and a fourth contact-type switches are turned on, and a second and a third contact-type switches are turned off. When the platen offset information is calculated in S31 of the position calculating process, the ON/OFF status of the four contact-type switches are obtained so that a predetermined offset amount corresponding to the status can be read from the platen information table storing area 121.

What is claimed is:

1. A printing apparatus, comprising:

a recording system with a nozzle surface from which ink is ejected onto a recording medium according to recording data;

a platen which is installed in a position to face the nozzle surface to hold the recording medium with a clearance provided between the nozzle surface and a surface of the recording medium held by the platen;

a feeding system configured to carry the platen to a recording position at which the recording system forms an image on the recording medium according to the recording data;

a detecting system configured to scan the surface of the recording medium to detect an object that may otherwise interfere with the nozzle surface on the recording medium by scanning the surface of the recording medium;

a scan objective area determining system configured to determine a scan objective area, which is an area to be scanned by the detecting system, based on a size of the platen and a record objective area being indicated in the recording data and on which the image is formed by the recording system; and a scan controlling system configured to control the detecting system to scan the scan objective area determined by the scan objective area determining system to detect the object on the recording medium.

2. The printing apparatus according to claim 1, wherein the platen is any one of a plurality of exchangeable platens;

the recording data includes information regarding at least one of a size and a type of the platen to be used in the printing apparatus; and the scan objective area determining system determines the area to be scanned based on the information regarding at least one of the size and the type of the platen.

3. The printing apparatus according to claim 1, further comprising:

a platen type detecting system configured to detect a type of the platen being installed in the printing apparatus, wherein the platen is any one of a plurality of exchangeable platens; and a platen size storing system configured to store a size of the platen for each type of the exchangeable platen is provided, wherein the scan objective area determining system is configured to determine the scan objective area by obtaining the size of the platen detected by the platen type detecting.

4. The printing apparatus according to claim 1 wherein the scan objective area ranges from a record finishing position, at which forming of the image is finished, to a record starting position, at which forming of the image is started, wherein the scan objective area determining system comprises:

a first detection finish feeding amount calculating system configured to execute a calculation to obtain a first detection finish feeding amount indicating an amount for the platen to be carried from a ready position, at which the platen stands by before an operation of the recording system to form the image, to a scanning finish position, at which the record starting position coincides with the recording position, based on the size of the platen and the record objective area being indicated in the recording data, and a first detection start feeding amount calculating system configured to execute a calculation to obtain a first detection start feeding amount indicating an amount by which the platen is carried from the ready position to a first scanning start position, at which the record finishing position coincides with the recording position, based on the size of the platen and the record objective area being indicated in the recording data;

wherein the scan controlling system activates the detecting system to scan the area on the recording medium including the scan objective area when the platen is carried from the ready position to the first scanning start position by the feeding system and ceases the detecting system scanning the scan objective area when the platen is carried to the first detection scanning finish position.

5. The printing apparatus according to claim 4, further comprising:

a reference platen having a size as a reference size; and a reference feeding amount storing system configured to store a reference detection start feeding amount, which is an amount by which the reference platen is carried from the ready position to a reference record starting position, at which an upper end of a record objective area of the reference platen coincides with the recording position;

wherein the platen has a vertical length which is parallel to a feeding direction of the platen and the reference platen has a vertical length which is parallel to a feeding direction of the reference platen;

wherein the first detection finish feeding amount calculating system executes the calculation to obtain the first detection finish feeding amount by:

obtaining a difference between one of the vertical length of the platen which is indicated in the recording data, the vertical length of the platen which is determined based on the type of the platen, and the vertical length of the platen which is obtained from the platen size storing system, and the vertical length of the reference platen;

dividing the difference by two;

combining a length from an upper end of the platen to the upper end of the record objective area with the divided difference; and subtracting the combined length from the reference detection start feeding amount stored in the reference feeding amount storing system;

wherein the recording data includes information indicating a feeding amount by which the platen is carried when the image is formed on the recording medium according to the recording data; and wherein the first detection start feeding amount calculating system executes the calculation to obtain the first detection start feeding amount by:

determining a vertical length of the record objective area based on the feeding amount by which the platen is carried when the image according to the recording data is formed within a range from the upper end to a lower end of the record objective area; and subtracting the vertical length of the record objective area from the first detection finish feeding amount.

6. The printing apparatus according to claim 1, wherein a side of the platen closer to a downstream side with respect to the feeding direction of the platen is a lower side of the platen when the platen is carried to the recording position by the feeding system so that the image is formed on the recording medium held by the platen;

the scan objective area ranges from the lower side of the platen to the record starting position, at which forming of the image by the recording system is started;

the scan objective area determining system comprises a second detection finish feeding amount calculating system, configured to execute a calculation to obtain a second detection finish feeding amount indicating an amount by which the platen is carried from a ready position, at which the platen stands by before an operation of the recording system to form the image, to a scanning finish position, at which the record starting position coincides with the recording position, based on the size of the platen and the record objective area being indicated in the recording data, and the scan controlling system activates the detecting system to scan the area on the recording medium including the scan objective area when the platen starts to be carried from the ready position to the second scanning start position by the feeding system and ceases the detecting system scanning the scan objective area when the platen is carried to the second detection scanning finish position.

7. The printing apparatus according to claim 6, further comprising:

a reference platen having a size as a reference size; and a reference feeding amount storing system configured to store a reference detection start feeding amount, which is an amount by which the reference platen is carried from the ready position to a reference record starting position, at which an upper end of a record objective area of the reference platen coincides with the recording position;

wherein the platen has a vertical length which is parallel to a feeding direction of the platen and the reference platen has a vertical length which is parallel to a feeding direction of the reference platen; and wherein the second detection finish feeding amount calculating system executes the calculation to obtain the second detection finish feeding amount by:

obtaining a difference between one of the vertical length of the platen which is indicated in the recording data, the vertical length of the platen which is determined based on the type of the platen, and the vertical length of the platen which is obtained from the platen size storing system, and the vertical length of the reference platen;

dividing the difference by two;

combining a length from an upper end of the platen to the upper end of the record objective area with the divided difference; and subtracting the combined length from the reference detection start feeding amount stored in the reference feeding amount storing system.

8. The printing apparatus according to claim 1, wherein the printing apparatus is configured to indicate an error to a user of the printing apparatus when the detecting system detects the object that may otherwise interfere with the nozzle surface of the recording system.

* * * * *